US008844461B2

(12) United States Patent
Thie et al.

(10) Patent No.: US 8,844,461 B2
(45) Date of Patent: Sep. 30, 2014

(54) FLUID HANDLING SYSTEM FOR WAFER ELECTROLESS PLATING AND ASSOCIATED METHODS

(75) Inventors: William Thie, Mountain View, CA (US); John M. Boyd, Woodlawn (CA); Fritz C. Redeker, Fremont, CA (US); Yezdi Dordi, Palo Alto, CA (US); John Parks, Hercules, CA (US); Tiruchirapalli Arunagiri, Fremont, CA (US); Aleksander Owczarz, San Jose, CA (US); Todd Balisky, Corona, CA (US); Clint Thomas, Milpitas, CA (US); Jacob Wylie, Fremont, CA (US); Alan M. Schoepp, Ben Lomond, CA (US)

(73) Assignee: Lam Research Corporation, Fremont, CA (US)

( * ) Notice: Subject to any disclaimer, the term of this patent is extended or adjusted under 35 U.S.C. 154(b) by 1197 days.

(21) Appl. No.: 11/735,989

(22) Filed: Apr. 16, 2007

(65) Prior Publication Data

US 2008/0251148 A1 Oct. 16, 2008

(51) Int. Cl.

| | |
|---|---|
| ***B05C 11/00*** | (2006.01) |
| ***B05D 1/28*** | (2006.01) |
| ***C23C 18/16*** | (2006.01) |

(52) U.S. Cl.

CPC ..... *C23C 18/1628* (2013.01)
USPC ..... 118/64; 427/430.1

(58) Field of Classification Search

USPC ..... 118/610, 603, 600, 422; 137/896, 220; 438/747

See application file for complete search history.

(56) References Cited

U.S. PATENT DOCUMENTS

| | | | | |
|---|---|---|---|---|
| 2,941,902 | A * | 6/1960 | Talmey et al. | 427/345 |
| 3,931,790 | A | 1/1976 | Franz | |
| 4,239,732 | A * | 12/1980 | Schneider | 422/133 |
| 4,887,411 | A * | 12/1989 | Rondeau et al. | 53/493 |
| 5,857,589 | A * | 1/1999 | Cline et al. | 222/1 |
| 5,918,976 | A * | 7/1999 | Hashimoto et al. | 366/132 |
| 6,060,176 | A | 5/2000 | Semkow et al. | |
| 6,171,367 | B1 * | 1/2001 | Peng et al. | 95/46 |
| 6,200,414 | B1 * | 3/2001 | Hwang et al. | 156/345.18 |
| 6,247,479 | B1 * | 6/2001 | Taniyama et al. | 134/95.2 |
| 6,258,223 | B1 | 7/2001 | Cheung et al. | |
| 6,335,104 | B1 | 1/2002 | Sambucetti et al. | |
| 6,889,627 | B1 | 5/2005 | Hao | |

(Continued)

FOREIGN PATENT DOCUMENTS

| | | |
|---|---|---|
| EP | 01061157 | 12/2000 |
| EP | 1243672 | 9/2002 |

(Continued)

*Primary Examiner* — Dah-Wei D Yuan
*Assistant Examiner* — Charles Capozzi
(74) *Attorney, Agent, or Firm* — Martine Penilla Group, LLP

(57) ABSTRACT

A chemical fluid handling system is defined to supply a number of chemicals to a number of fluid inputs of a mixing manifold. The chemical fluid handling system includes a number of fluid recirculation loops for separately pre-conditioning and controlling the supply of each of the number of chemicals. Each of the fluid recirculation loops is defined to degas, heat, and filter a particular one of the number of chemical components. The mixing manifold is defined to mix the number of chemicals to form the electroless plating solution. The mixing manifold includes a fluid output connected to a supply line. The supply line is connected to supply the electroless plating solution to a fluid bowl within an electroless plating chamber.

23 Claims, 17 Drawing Sheets

(56) References Cited

U.S. PATENT DOCUMENTS

| | | | | |
|---|---|---|---|---|
| 6,926,817 | B2 | 8/2005 | Marumo et al. | |
| 2002/0166575 | A1 | 11/2002 | Marumo et al. | |
| 2003/0073845 | A1 | 4/2003 | Barta et al. | |
| 2003/0113576 | A1 | 6/2003 | Chebiam et al. | |
| 2003/0118732 | A1 | 6/2003 | Stevens et al. | |
| 2003/0181040 | A1 | 9/2003 | Ivanov et al. | |
| 2003/0200926 | A1 | 10/2003 | Dando et al. | |
| 2004/0016637 | A1* | 1/2004 | Yang et al. | 204/242 |
| 2004/0035316 | A1 | 2/2004 | Chebiam et al. | |
| 2004/0038073 | A1 | 2/2004 | Chebiam et al. | |
| 2004/0045502 | A1* | 3/2004 | Yokoyama et al. | 118/429 |
| 2004/0057334 | A1* | 3/2004 | Wilmer et al. | 366/136 |
| 2004/0083978 | A1 | 5/2004 | Welch et al. | |
| 2004/0154535 | A1 | 8/2004 | Chen et al. | |
| 2004/0182422 | A1* | 9/2004 | Boyd et al. | 134/18 |
| 2004/0198190 | A1* | 10/2004 | Basol et al. | 451/41 |
| 2004/0235237 | A1 | 11/2004 | Inoue et al. | |
| 2005/0051093 | A1 | 3/2005 | Makino et al. | |
| 2005/0051437 | A1* | 3/2005 | Kurashina et al. | 205/143 |
| 2005/0081785 | A1 | 4/2005 | Lubomirsky et al. | |
| 2005/0160990 | A1 | 7/2005 | Lubomirsky et al. | |
| 2005/0163916 | A1* | 7/2005 | Dubin et al. | 427/58 |
| 2005/0181135 | A1 | 8/2005 | Ivanov et al. | |
| 2005/0181226 | A1* | 8/2005 | Weidman et al. | 428/544 |
| 2006/0037858 | A1 | 2/2006 | Marumo et al. | |
| 2006/0081461 | A1 | 4/2006 | Jomen et al. | |

FOREIGN PATENT DOCUMENTS

| | | | | |
|---|---|---|---|---|
| JP | S57-41363 | | 3/1982 | |
| JP | 11-092949 | | 4/1999 | |
| JP | 2000064087 | | 2/2000 | |
| JP | 2000319797 | | 11/2000 | |
| JP | 2001073157 | | 3/2001 | |
| JP | 2001-192845 | | 7/2001 | |
| JP | 2001-192845 | A | 7/2001 | H01L 21/288 |
| JP | 2001192845 | * | 7/2001 | C23C 18/16 |
| JP | 2001-316834 | | 11/2001 | |
| JP | 2001-342573 | A | 12/2001 | H01L 21/288 |
| JP | 2002129344 | | 5/2002 | |
| JP | 2002367998 | | 12/2002 | |
| JP | 2004084020 | | 3/2004 | |
| JP | 2005068494 | | 3/2005 | |
| JP | 2006501360 | | 1/2006 | |
| KR | 10-2005-0057334 | | 6/2005 | |
| TW | 478056 | | 3/2002 | |
| TW | 527633 | | 4/2003 | |
| TW | I247056 | | 1/2006 | |
| TW | I251511 | | 3/2006 | |
| TW | I278358 | | 4/2007 | |
| WO | WO 0148800 | | 7/2001 | |
| WO | WO 2005073429 | | 8/2005 | |

* cited by examiner

FLUID HANDLING SYSTEM FOR WAFER ELECTROLESS PLATING AND ASSOCIATED METHODS

CROSS REFERENCE TO RELATED APPLICATIONS

This application is related to U.S. patent application Ser. No. 11/735,984, filed on even date herewith, entitled "Wafer Electroless Plating System and Associated Methods," and U.S. patent application Ser. No. 11/735,987, filed on even date herewith, entitled "Method and Apparatus for Wafer Electroless Plating," and U.S. patent application Ser. No. 11/639,752, filed on Dec. 15, 2006, entitled "Controlled Ambient System for Interface Engineering," and U.S. Pat. No. 7,045,018, entitled "Substrate Brush Scrubbing and Proximity Cleaning-Drying Sequence Using Compatible Chemistries, and Method, Apparatus, and System for Implementing the Same," and U.S. patent application Ser. No. 11/016,381, filed on Dec. 16, 2004, entitled "System Method and Apparatus for Dry-in, Dry-out Low Defect Laser Dicing Using Proximity Technology," and U.S. patent application Ser. No. 10/882,716, filed on Jun. 30, 2004, entitled "Proximity Substrate Preparation Sequence, and Method, Apparatus, and System for Implementing the Same," and U.S. patent application Ser. No. 11/382,906, filed on May 11, 2006, entitled "Plating Solution for Electroless Deposition of Copper," and U.S. patent application Ser. No. 11/427,266, filed on Jun. 28, 2006, entitled "Plating Solutions for Electroless Deposition of Copper," and U.S. patent application Ser. No. 11/639,012, filed on Dec. 13, 2006, entitled "Self Assembled Monolayer for Improving Adhesion Between Copper and Tantalum," and U.S. patent application Ser. No. 11/591,310, filed on Oct. 31, 2006, entitled "Methods of Fabricating a Barrier Layer with Varying Composition for Copper Metallization," and U.S. patent application Ser. No. 11/552,794, filed on Oct. 25, 2006, entitled "Apparatus and Method for Substrate Electroless Plating," and U.S. Pat. No. 7,153,400, entitled "Apparatus and Method for Depositing and Planarizing Thin Films of Semiconductor Wafers," and U.S. patent application Ser. No. 11/539,155, filed on Oct. 5, 2006, entitled "Electroless Plating Method and Apparatus," and U.S. patent application Ser. No. 11/611,758, filed on Dec. 15, 2006, entitled "Method for Gap Fill in Controlled Ambient System." The disclosure of each of the above-identified related applications is incorporated herein by reference.

BACKGROUND OF THE INVENTION

In the fabrication of semiconductor devices such as integrated circuits, memory cells, and the like, a series of manufacturing operations are performed to define features on semiconductor wafers ("wafers"). The wafers include integrated circuit devices in the form of multi-level structures defined on a silicon substrate. At a substrate level, transistor devices with diffusion regions are formed. In subsequent levels, interconnect metallization lines are patterned and electrically connected to the transistor devices to define a desired integrated circuit device. Also, patterned conductive layers are insulated from other conductive layers by dielectric materials.

To build an integrated circuit, transistors are first created on the surface of the wafer. The wiring and insulating structures are then added as multiple thin-film layers through a series of manufacturing process steps. Typically, a first layer of dielectric (insulating) material is deposited on top of the formed transistors. Subsequent layers of metal (e.g., copper, aluminum, etc.) are formed on top of this base layer, etched to create the conductive lines that carry the electricity, and then filled with dielectric material to create the necessary insulators between the lines.

Although copper lines are typically comprised of a PVD seed layer (PVD Cu) followed by an electroplated layer (ECP Cu), electroless chemistries are under consideration for use as a PVD Cu replacement, and even as a ECP Cu replacement. Electroless copper (Cu) and electroless cobalt (Co) are potential techniques for improving interconnect reliability and performance. Electroless Cu can be used to form a thin conformal seed layer on a conformal barrier to optimize a gapfill process and minimize void formation. Further, deposition of a selective Co capping layer on planarized Cu lines can improve adhesion of the dielectric barrier layer to the Cu lines, and suppress void formation and propagation at the Cu-dielectric barrier interface.

During the electroless plating process, electrons are transferred from a reducing agent to the Cu (or Co) ions in the solution resulting in the deposition of reduced Cu (or Co) onto the wafer surface. The formulation of the electroless copper plating solution is optimized to maximize the electron transfer process involving the Cu (or Co) ions in solution. The plating thickness achieved through the electroless plating process is dependent on the residency time of the electroless plating solution on the wafer. Because the electroless plating reactions occur immediately and continuously upon exposure of the wafer to the electroless plating solution, it is desirable to perform the electroless plating process in a controlled manner and under controlled conditions. To this end, a need exists for an improved electroless plating apparatus.

SUMMARY OF THE INVENTION

In one embodiment, a fluid handling module for a semiconductor wafer electroless plating chamber is disclosed. The fluid handling module includes a supply line, a mixing manifold, and a chemical fluid handling system. The first supply line is connected to supply an electroless plating solution to a fluid bowl within the chamber. The mixing manifold includes a fluid output connected to the first supply line. The mixing manifold also includes a number of fluid inputs for respectively receiving a number of chemicals. The mixing manifold is defined to mix the number of chemicals to form the electroless plating solution. The chemical fluid handling system is defined to supply the number of chemicals to the number of fluid inputs of the mixing manifold in a controlled manner.

In another embodiment, a fluid handling system for a semiconductor wafer electroless plating process is disclosed. The fluid handling system includes a number of fluid recirculation loops. Each fluid recirculation loop is defined to pre-condition a chemical component of an electroless plating solution. Each fluid recirculation loop is also defined to control a supply of the chemical component to be used to form the electroless plating solution. The fluid handling system also includes a mixing manifold defined to receive the chemical component from each fluid recirculation loop and mix the received chemical components to form the electroless plating solution. The mixing manifold is further defined to supply the electroless plating solution to be disposed over a wafer.

In another embodiment, a method is disclosed for operating a fluid handling system to support a semiconductor wafer electroless plating process. The method includes an operation for recirculating each of a number of chemical components of an electroless plating solution in a separate and pre-conditioned state. The number of chemical components are mixed to form the electroless plating solution. Mixing of the chemical components is performed downstream and separate from the recirculation of the chemical components. The method also includes an operation for flowing the electroless plating solution to a number of dispense locations within an electroless plating chamber. The mixing is performed at a location so as to minimize a flow distance of the electroless plating solution to the number of dispense locations.

Other aspects and advantages of the invention will become more apparent from the following detailed description, taken in conjunction with the accompanying drawings, illustrating by way of example the present invention.

DETAILED DESCRIPTION

In the following description, numerous specific details are set forth in order to provide a thorough understanding of the present invention. It will be apparent, however, to one skilled in the art that the present invention may be practiced without some or all of these specific details. In other instances, well known process operations have not been described in detail in order not to unnecessarily obscure the present invention.

Figure 1:
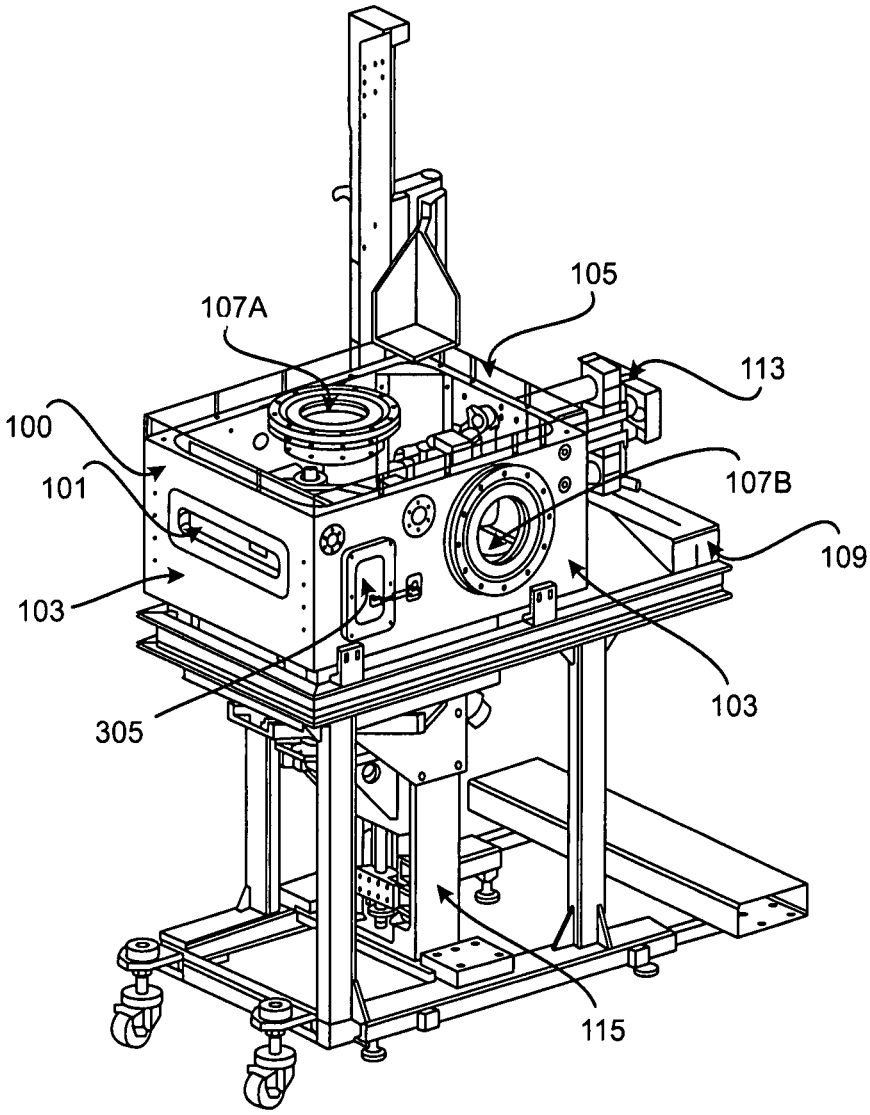
FIG. 1 is an illustration showing an isometric view of a dry-in/dry-out electroless plating chamber, in accordance with one embodiment of the present invention.

FIG. 1 is an illustration showing an isometric view of a dry-in/dry-out electroless plating chamber 100 ("chamber 100" hereafter), in accordance with one embodiment of the present invention. The chamber 100 is defined to receive a wafer in a dry state, perform an electroless plating process on the wafer, perform a rinsing process on the wafer, perform a drying process on the wafer, and provide the processed wafer in a dry state. The chamber 100 is capable of performing essentially any type of electroless plating process. For example, the chamber 100 is capable of performing an electroless Cu or Co plating process on the wafer. Additionally, the chamber 100 is configured to be integrated within a modular wafer processing system. For example, in one embodiment, the chamber 100 is connected with a managed atmospheric transfer module (MTM). For additional information regarding the MTM, reference can be made to U.S. patent application Ser. No. 11/639,752, filed on Dec. 15, 2006, and entitled "Controlled Ambient System for Interface Engineering," which is incorporated herein by reference.

For more information on electroless plating, reference can be made to: (1) U.S. patent application Ser. No. 11/382,906, filed on May 11, 2006, entitled "Plating Solution for Electroless Deposition of Copper," (2) U.S. patent application Ser. No. 11/427,266, filed on Jun. 28, 2006, entitled "Plating Solutions for Electroless Deposition of Copper," (3) U.S. patent application Ser. No. 11/639,012, filed on Dec. 13, 2006, entitled "Self Assembled Monolayer for Improving Adhesion Between Copper and Tantalum," (4) U.S. patent application Ser. No. 11/591,310, filed on Oct. 31, 2006, entitled "Methods of Fabricating a Barrier Layer with Varying Composition for Copper Metallization," (5) U.S. patent application Ser. No. 11/552,794, filed on Oct. 25, 2006, entitled "Apparatus and Method for Substrate Electroless Plating," (6) U.S. Pat. No. 7,153,400, entitled "Apparatus and Method for Depositing and Planarizing Thin Films of Semiconductor Wafers," (7) U.S. patent application Ser. No. 11/539,155, filed on Oct. 5, 2006, entitled "Electroless Plating Method and Apparatus," and (8) U.S. patent application Ser. No. 11/611,758, filed on Dec. 15, 2006, entitled "Method for Gap Fill in Controlled Ambient System," each of which is incorporated herein by reference.

The chamber 100 is equipped to receive a wafer in a dry state from an interfacing module, such as the MTM. The chamber 100 is equipped to perform an electroless plating process on the wafer within the chamber 100. The chamber 100 is defined to perform a drying process on the wafer within the chamber 100. The chamber 100 is defined to provide the wafer in a dry state back to the interfacing module. It should be appreciated that the chamber 100 is defined to perform the electroless plating process and the drying process on the wafer within a common internal volume of the chamber 100. Additionally, a fluid handling system (FHS) is provided to support the wafer electroless plating process and the wafer drying process within the common internal volume of the chamber 100.

The chamber 100 includes a first wafer processing zone defined within an upper region of an internal volume of the chamber 100. The first wafer processing zone is equipped to perform the drying process on the wafer when disposed within the first wafer processing zone. The chamber 100 also includes a second wafer processing zone defined within a lower region of the internal volume of the chamber 100. The second wafer processing zone is equipped to perform the electroless plating process on the wafer when disposed within the second wafer processing zone. Additionally, the chamber 100 includes a platen that is vertically movable between the first and second wafer processing zones within the internal volume of the chamber 100. The platen is defined to transport the wafer between the first and second processing zones and support the wafer within the second processing zone during the electroless plating process.

With regard to FIG. 1, the chamber 100 is defined by outer structure walls 103 including an outer structural bottom and a structural top 105. The outer structure of the chamber 100 is capable of resisting forces associated with a sub-atmospheric pressure, i.e., vacuum, condition within the internal volume of the chamber 100. The outer structure of the chamber 100 is also capable of resisting forces associated with an above-atmospheric pressure condition within the internal volume of the chamber 100. In one embodiment, the structural top 105 of the chamber is equipped with a window 107A. Additionally, in one embodiment a window 107B is provided in an outer structural wall 103 of the chamber. It should be understood, however, that the windows 107A and 107B are not critical to the operation of the chamber 100. For example, in one embodiment, the chamber 100 is defined without windows 107A and 107B.

The chamber 100 is defined to sit atop a frame assembly 109. It should be understood that other embodiments may utilize a frame assembly that is different from the exemplary frame assembly 109 depicted in FIG. 1. The chamber 100 is defined to include an entry door 101 through which a wafer is inserted into and removed from the chamber 100. The chamber 100 further includes a stabilizer assembly 305, a platen lift assembly 115, and a proximity head drive mechanism 113, each of which will be described in more detail below.

Figure 2:
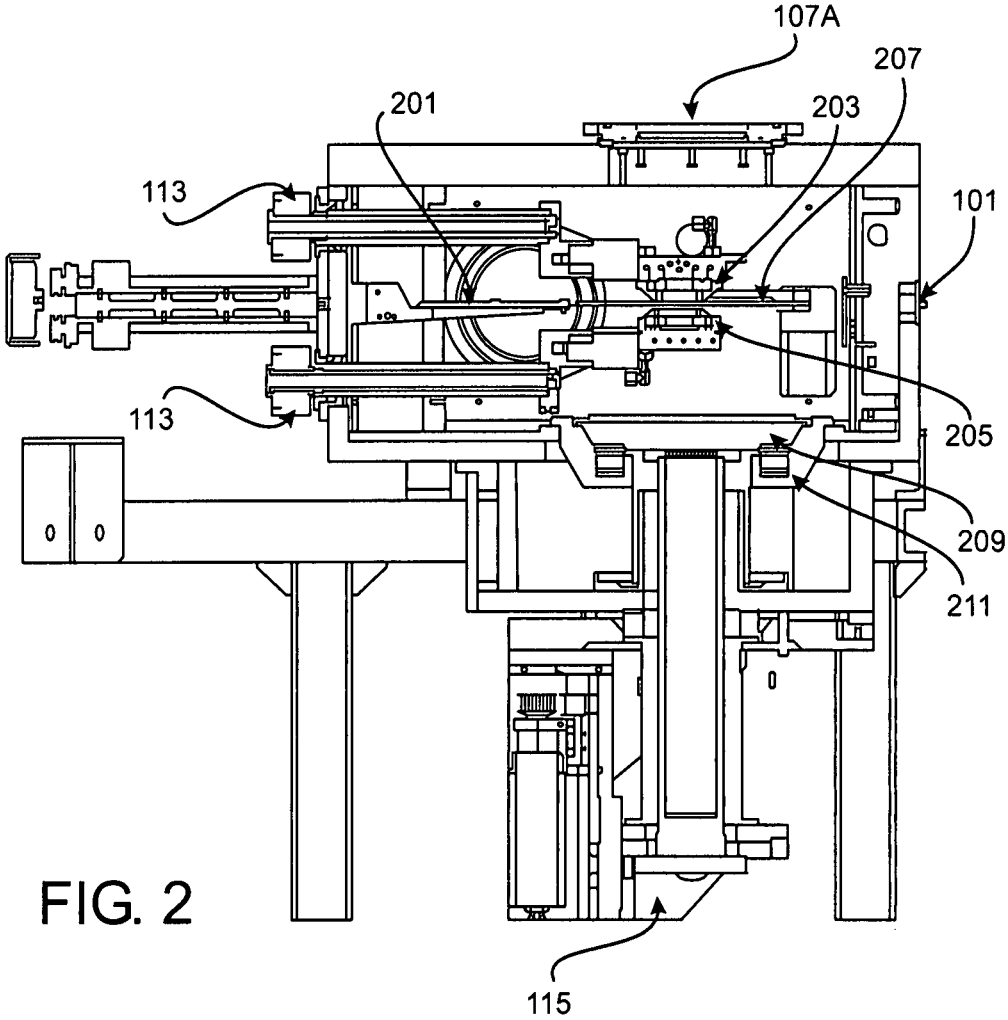
FIG. 2 is an illustration showing a vertical cross-section through a center of the chamber, in accordance with one embodiment of the present invention.

FIG. 2 is an illustration showing a vertical cross-section through a center of the chamber 100, in accordance with one embodiment of the present invention. The chamber 100 is defined such that when a wafer 207 is inserted through the entry door 101, the wafer 207 will be engaged by a drive roller assembly 303 (not shown) and the stabilizer assembly 305 within the upper region of the chamber internal volume. By way of the platen lift assembly 115, a platen 209 is defined to travel in a vertical direction between the upper and lower regions of the chamber internal volume. The platen 209 is defined to receive the wafer 207 from the drive roller assembly 303 and stabilizer assembly 305, and move the wafer 207 to the second wafer processing zone in the lower region of the chamber internal volume. As will be described in more detail below, within the lower region of the chamber, the platen 209 is defined to interface with a fluid bowl 211 to enable the electroless plating process.

Following the electroless plating process within the lower region of the chamber, the wafer 207 is lifted via the platen 209 and platen lift assembly 115 back to the position where it can be engaged by the drive roller assembly 303 and the stabilizer assembly 305. Once securely engaged by the drive roller assembly 303 and the stabilizer assembly 305, the platen 209 is lowered to a position within the lower region of the chamber 100. The wafer 207, having been subjected to the electroless plating process, is then dried by way of an upper proximity ("prox" hereafter) head 203 and a lower prox head 205. The upper prox head 203 is defined to dry an upper surface of the wafer 207. The lower prox head is defined to dry a lower surface of the wafer 207.

By way of the prox head drive mechanism 113, the upper and lower prox heads 203/205 are defined to move in a linear manner across the wafer 207 when the wafer 207 is engaged by the drive roller assembly 303 and the stabilizer assembly 305. In one embodiment, the upper and lower prox heads 203/205 are defined to move to a center of the wafer 207 as the wafer 207 is rotated by the drive roller assembly 303. In this manner, the wafer 207 upper and lower surfaces can be completely exposed to the upper and lower prox heads 203/205, respectively. The chamber 100 further includes a prox head docking station 201 for receiving each of the upper and lower prox heads 203/205 when retracted to their home position. The prox head docking station 201 also provides for a smooth transition of the meniscus associated with each of the upper and lower prox heads 203/205 as the meniscus transitions onto the wafer 207. The prox head docking station 201 is positioned within the chamber so as to ensure that when the upper and lower prox heads 203/205 are retracted to their respective home positions, the upper and lower prox heads 203/205 do not interfere with the drive roller assembly 303, the stabilizer assembly 305, or the platen 209 when raised to receive the wafer 207.

Figure 3:
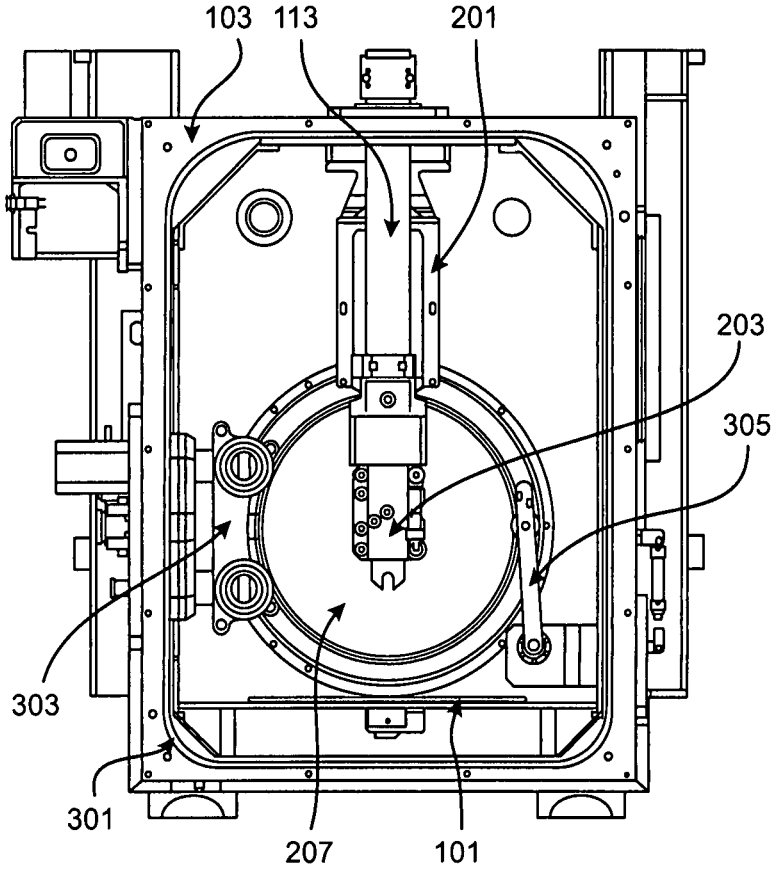
FIG. 3 is an illustration showing a top view of the chamber with the upper prox head extended to the center of the wafer, in accordance with one embodiment of the present invention.
Figure 4:
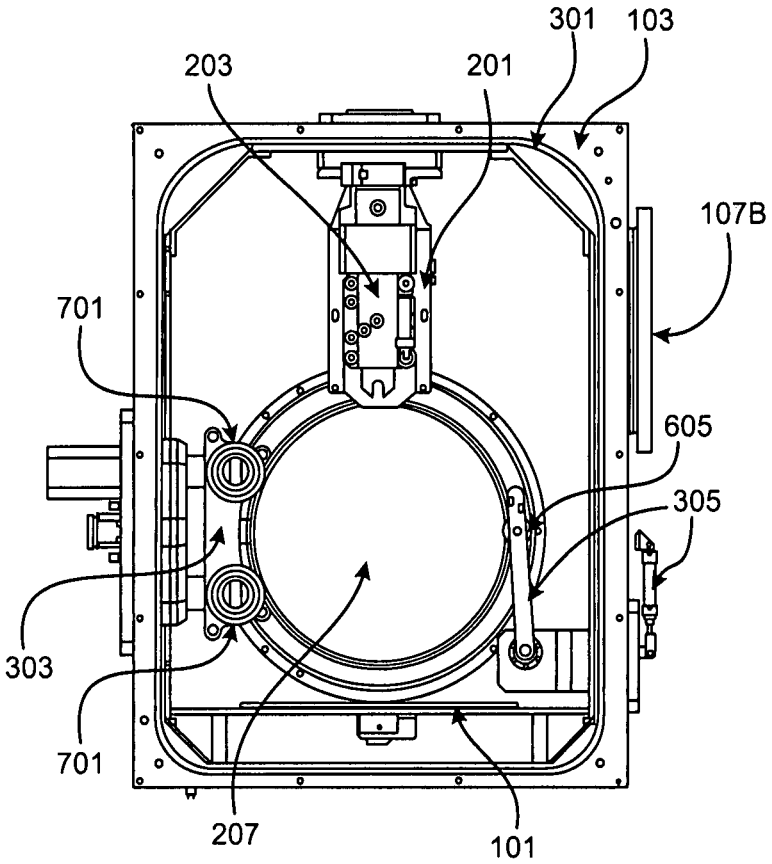
FIG. 4 is an illustration showing a top view of the chamber with the upper prox head retracted to the home position over the prox head docking station, in accordance with one embodiment of the present invention.

FIG. 3 is an illustration showing a top view of the chamber with the upper prox head 203 extended to the center of the wafer 207, in accordance with one embodiment of the present invention. FIG. 4 is an illustration showing a top view of the chamber with the upper prox head 203 retracted to the home position over the prox head docking station 201, in accordance with one embodiment of the present invention. As previously mentioned, when the wafer 207 is received within the chamber 100 through the entry door 101, the wafer is engaged and held by the drive roller assembly 303 and the stabilizer assembly 305. By way of the prox head drive mechanism 113, the upper prox head 203 can be moved in a linear manner from its home position on the prox head docking station 201 to the center of the wafer 207. Similarly, by way of the prox head drive mechanism 113, the lower prox head 205 can be moved in a linear manner from its home position on the prox head docking station 201 to the center of the wafer 207. In one embodiment, the prox head drive mechanism 113 is defined to move the upper and lower prox heads 203/205 together from the prox head docking station 201 to the center of the wafer 207.

As shown in FIG. 3, the chamber 100 is defined by the outer structural walls 103 and an inner liner 301. Thus, the chamber 100 incorporates a double-wall system. The outer structural walls 103 have sufficient strength to provide a vacuum capability within the chamber 100 and thereby form a vacuum boundary. In one embodiment, the outer structural walls 103 are formed of a structural metal such as stainless steel. It should be understood, however, that essentially any other structural material having appropriate strength characteristics can be used to form the outer structural walls 103. The outer structural walls 103 are also defined with sufficient precision to enable interfacing of the chamber 100 with another module, such as the MTM.

The inner liner 301 provides a chemical boundary and acts as a separator to keep chemicals within the chamber from reaching the outer structural walls 103. The inner liner 301 is formed of an inert material that is chemically compatible with the various chemicals that may be present within the chamber 100. In one embodiment, the inner liner 301 is formed of an inert plastic material. It should be understood, however, that essentially any other chemically inert material that can be appropriately shaped can be used to form the inner liner 301.

It should also be understood that the inner liner 301 is not required to provide a vacuum boundary. As previously mentioned, the outer structural walls 103 are defined to provide the vacuum boundary. Additionally, in one embodiment, the inner liner 301 can be removed from the chamber 100 to facilitate cleaning or to simply be replaced with a new inner liner 301.

The chamber 100 is defined to be ambient controlled to facilitate the wafer electroless plating process and protect the wafer surface from undesirable reactions, e.g., oxidation. To this end, the chamber 100 is equipped with an internal pressure control system and an internal oxygen content control system. In one embodiment, the chamber 100 is capable of being pumped down to a pressure of less than 100 mTorr. In one embodiment, it is anticipated that the chamber 100 will be operated at approximately 700 Torr.

It should be appreciated that the oxygen concentration within the chamber 100 internal volume is an important process parameter. More specifically, a low oxygen concentration is required in the wafer processing environment to ensure that undesirable oxidation reactions are avoided at the wafer surface. It is anticipated that the oxygen concentration within the chamber 100 internal volume will be maintained at a level less than 2 ppm (parts per million) when the wafer is present within the chamber 100. The oxygen concentration within the chamber 100 is reduced by evacuating the chamber, by way of a vacuum source plumbed to the internal volume of the chamber 100, and refilling the chamber 100 internal volume with high purity nitrogen. Therefore, the oxygen concentration within the chamber 100 internal volume is reduced from atmospheric levels, i.e., about 20% oxygen, by pumping the chamber 100 internal volume down to a low pressure and refilling the chamber 100 internal volume with ultra pure nitrogen which has a negligible oxygen content. In one embodiment, pumping the chamber 100 internal volume down to 1 Torr and refilling it to atmospheric pressure with ultra pure nitrogen three times should bring the oxygen concentration within the chamber 100 internal volume down to about 3 ppm.

The electroless plating process is a temperature sensitive process. Therefore, it is desirable to minimize the influence of the chamber 100 internal volume ambient conditions on the temperature of the electroless plating solution when present on the wafer surface. To this end, the chamber 100 is defined such that gases can be introduced into the chamber 100 internal volume through air gaps present between the outer structural walls 103 and the inner liner 301, so as to avoid flowing of gases directly over the wafer. It should be appreciated that a flow of gas directly over the wafer when electroless plating solution is present on the wafer surface could cause an evaporative cooling effect that would reduce the temperature of the electroless plating solution present on the wafer, and correspondingly modify the electroless plating reaction rate. In addition to the capability of indirectly introducing gas into the chamber 100 internal volume, the chamber 100 is also equipped to allow a vapor pressure within the chamber 100 internal volume to be raised to a saturated state when the electroless plating solution is applied over the wafer surface. With the chamber 100 internal volume in a saturated state relative to the electroless plating solution, the above-mentioned evaporative cooling effect would be minimized.

With reference back to FIGS. 3 and 4, the stabilizer assembly 305 includes a stabilizer roller 605 that is defined to apply pressure to the edge of the wafer 207 so as to hold the wafer 207 in the drive roller assembly 303. Thus, the stabilizer roller 605 is defined to engage the edge of the wafer 207. The stabilizer roller 605 profile is defined to accommodate an amount of angular misalignment between the stabilizer roller 605 and the wafer 207. Also, the stabilizer assembly 305 is defined to enable mechanical adjustment of the stabilizer roller 605 vertical position. The stabilizer assembly 305 shown in FIG. 6 includes a single stabilizer roller 605 to accommodate a 200 mm wafer. In another embodiment, the stabilizer assembly 305 can be defined with two stabilizer rollers 605 to accommodate a 300 mm wafer.

Also with reference back to FIGS. 3 and 4, the drive roller assembly 303 includes a pair of drive rollers 701 defined to engage the edge of the wafer 207 and rotate the wafer 207. Each of the drive rollers 701 is defined to engage the edge of the wafer 207. The profile of each drive roller 701 is defined to accommodate an amount of angular misalignment between the drive roller 701 and the wafer 207. Also, the drive roller assembly 303 is defined to enable mechanical adjustment of the vertical position of each drive roller 701. The drive roller assembly 303 is capable of moving the drive rollers 701 toward and away from the edge of the wafer 207. Engagement of the stabilizer roller 605 with the edge of the wafer 207 will cause the drive rollers 701 to engage the edge of the wafer 207.

Figure 5:
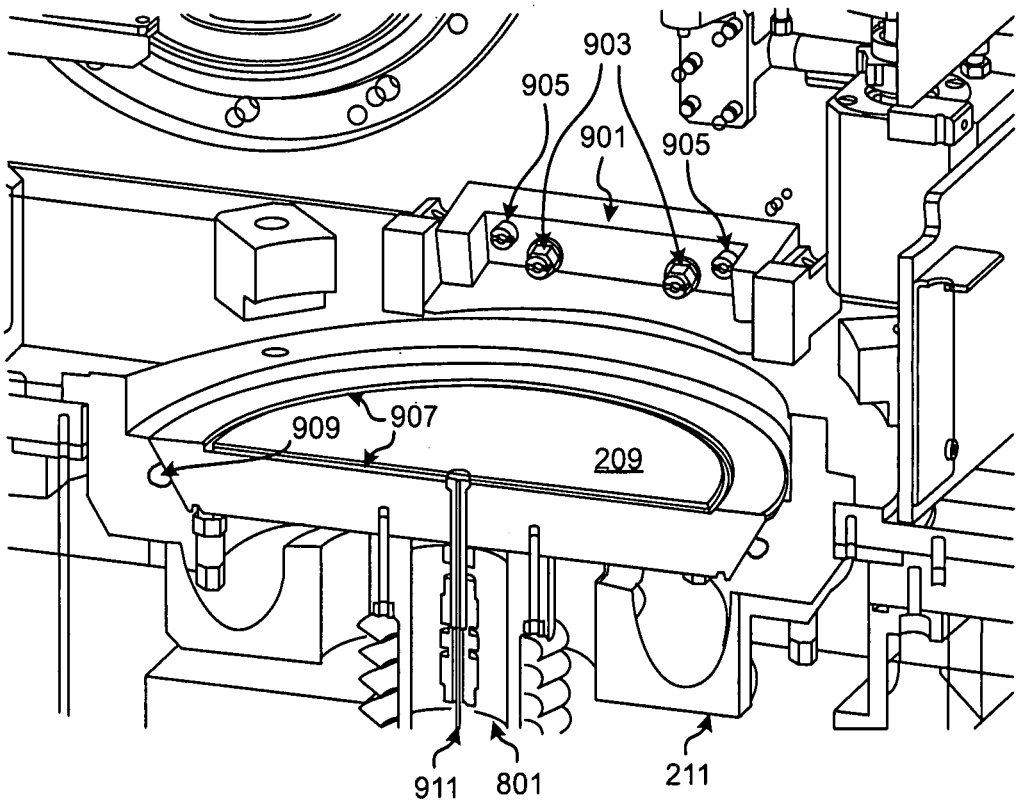
FIG. 5 is an illustration showing a vertical cross-section through the platen and fluid bowl with the platen in a fully lowered position, in accordance with one embodiment of the present invention.

With reference back to FIG. 2, the platen lift assembly 115 is defined to move the wafer 207 on the platen 209 from the wafer rotation plane, i.e., the plane where the wafer is engaged by the drive rollers 701 and stabilizer roller 605, to the processing position where the platen 209 engages a seal of the fluid bowl 211. FIG. 5 is an illustration showing a vertical cross-section through the platen 209 and fluid bowl 211 with the platen 209 in a fully lowered position, in accordance with one embodiment of the present invention. The platen 209 is defined as a heated vacuum chuck. In one embodiment, the platen 209 is fabricated from a chemically inert material. In another embodiment, the platen 209 is coated with a chemically inert material. The platen 209 includes vacuum channels 907 connected to a vacuum supply 911, which upon actuation will vacuum clamp the wafer 207 to the platen 209. Vacuum clamping of the wafer 207 to the platen 209 decreases a thermal resistance between the platen 209 and the wafer 207 and also prevents the wafer 207 from sliding during vertical transport within the chamber 100.

In various embodiments, the platen 209 can be defined to accommodate a 200 mm wafer or a 300 mm wafer. Additionally, it should be appreciated that the platen 209 and chamber 100 can be defined to accommodate essentially any size wafer. For a given wafer size, a diameter of the platen 209 upper surface, i.e., clamping surface, is defined to be slightly less than a diameter of the wafer. This platen-to-wafer sizing arrangement enables the edge of the wafer to extend slightly beyond the upper peripheral edge of the platen 209, thus enabling engagement between the wafer edge and each of the stabilizer roller 605 and drive rollers 701 when the wafer is sitting upon the platen 209.

As previously mentioned, the electroless plating process is a temperature sensitive process. The platen 209 is defined to be heated so that the temperature of the wafer 207 can be controlled. In one embodiment, the platen 209 is capable of maintaining a temperature up to 100° C. Also, the platen 209 is capable of maintaining a temperature as low as 0° C. It is anticipated that a normal platen 209 operating temperature will be about 60° C. In the embodiment where the platen 209 is sized to accommodate a 300 mm wafer, the platen 209 is defined with two interior resistive heating coils so as to form an inner heating zone and an outer heating zone, respectively. Each heating zone includes its own control thermocouple. In one embodiment, the inner heating zone utilizes a 700 Watt (W) resistive heating coil, and the outer zone utilizes a 2000

W resistive heating coil. In the embodiment where the platen 209 is sized to accommodate a 200 mm wafer, the platen 209 includes a single heating zone defined by a 1250 W interior heating coil and corresponding control thermocouple.

The fluid bowl 211 is defined to receive the platen 209 when the platen 209 is fully lowered within the chamber 100. The fluid holding capability of the fluid bowl 211 is completed when the platen 209 is lowered to engage a fluid bowl seal 909 defined about an inner periphery of the fluid bowl 211. In one embodiment, the fluid bowl seal 909 is an energized seal which forms a liquid tight seal between the platen 290 and fluid bowl 211, when the platen 209 is lowered to fully contact the fluid bowl seal 909. It should be appreciated that when the platen 209 is lowered to engage the fluid bowl seal 909, a gap exists between the platen 209 and the fluid bowl 211. Thus, engagement of the platen 209 with the fluid bowl seal 909 allows an electroless plating solution to be injected into the bowl so as to fill the gap that exists between the platen 209 and the fluid bowl 211 above the fluid bowl seal 909, and well-up over the periphery of the wafer 207 that is clamped on the upper surface of the platen 209.

In one embodiment, the fluid bowl 211 includes eight fluid dispense nozzles for dispensing of the electroless plating solution within the fluid bowl 211. The fluid dispense nozzles are distributed in a uniformly spaced manner around the fluid bowl 211. Each of the fluid dispense nozzles is fed by a tube from a distribution manifold such that a fluid dispense rate from each fluid dispense nozzle is substantially the same. Also, the fluid dispense nozzles are disposed such that fluid emanating from each of the fluid dispense nozzles enters the fluid bowl 211 at a location below the upper surface of the platen 209, i.e., below the wafer 207 that is clamped on the upper surface of the platen 209. Additionally, when the platen 209 and wafer 207 are not present in the fluid bowl 211, the fluid bowl 211 can be cleaned by injecting a cleaning solution into the fluid bowl 211 through the fluid dispense nozzles. The fluid bowl 211 can be cleaned at a user defined frequency. For example, the fluid bowl can be cleaned as frequently as after processing of every wafer, or as infrequently as once every 100 wafers.

The chamber 100 also includes a rinse bar 901, which includes a number of rinse nozzles 903 and a number of blowdown nozzles 905. The rinse nozzles 903 are directed to spray rinse fluid on the top surface of the wafer 207 when the platen 209 is moved to place the wafer 207 in rinse position. At the rinse position, a space will exist between the platen 209 and the fluid bowl seal 909 to enable flow of rinse fluid into the fluid bowl 211 from which it can be drained. In one embodiment, two rinse nozzles 903 are provided for rinsing a 300 mm wafer, and one rinse nozzle 903 is provided for rinsing a 200 mm wafer. The blowdown nozzles 905 are defined to direct an inert gas, such as nitrogen, toward the top surface of the wafer to assist in removing fluid from the top surface of the wafer during the rinsing process. It should be appreciated that because the electroless plating reactions continuously occur when the electroless plating solution is in contact with the wafer surface, it is necessary to promptly and uniformly remove the electroless plating solution from the wafer upon completion of the electroless plating period. To this end, the rinse nozzles 903 and blowdown nozzles 905 enable prompt and uniform removal of the electroless plating solution from the wafer 207.

Figure 6A:
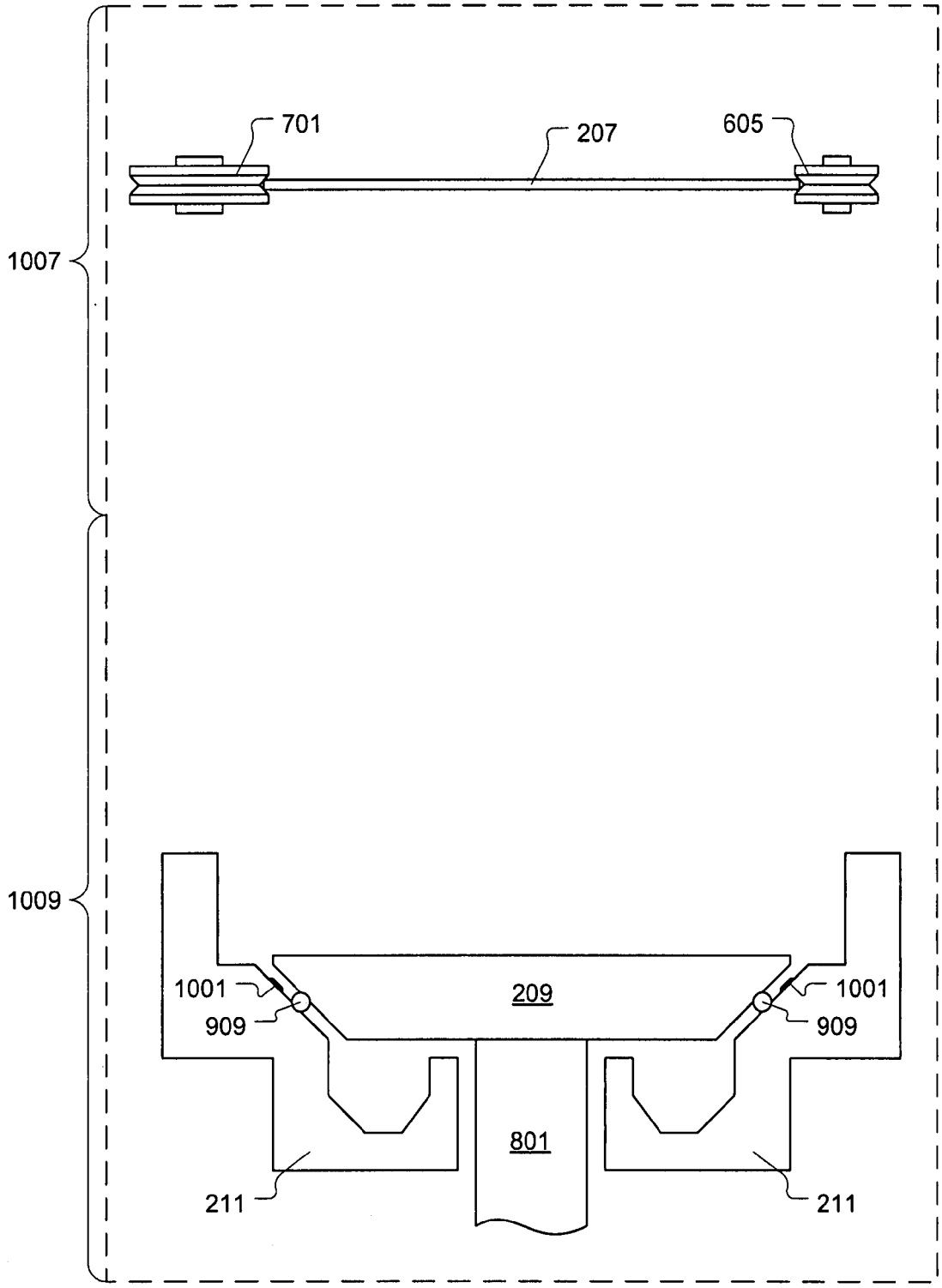
FIG. 6A is an illustration showing the wafer in the wafer handoff position within the chamber, in accordance with one embodiment of the present invention.

FIG. 6A is an illustration showing the wafer 207 in the wafer handoff position within the chamber 100, in accordance with one embodiment of the present invention. The chamber 100 is operated to accept a wafer from an exterior module, e.g., MTM, to which the chamber 100 is connected. In one embodiment, the entry door 101 is lowered and the wafer 207 is input to the chamber 100 by way of a robotic wafer handling device. When the wafer 207 is placed in the chamber 100, the drive rollers 701 and the stabilizer roller 605 are in their fully retracted positions. The wafer 207 is positioned in the chamber 100 such that the edge of the wafer 207 is proximate to the drive rollers 701 and the stabilizer roller 605. The drive rollers 701 and stabilizer roller 605 are then moved toward the edge of the wafer 207 so as to engage the edge of the wafer 207, as shown in FIG. 6A.

It should be appreciated that the wafer handoff position is also the wafer drying position within the chamber 100. The wafer handoff and drying processes occur within an upper region 1007 of the chamber 100. The fluid bowl 211 resides in a lower region 1009 of the chamber 100, directly below the wafer-handoff position. This configuration enables the platen 209 to be raised and lowered to enable movement of the wafer 207 from the wafer-handoff position to the wafer processing position in the lower region 1009. During the wafer handoff process, the platen 209 is in a fully lowered position to avoid interference of the platen 209 with the robotic wafer handling device.

Figure 6B:
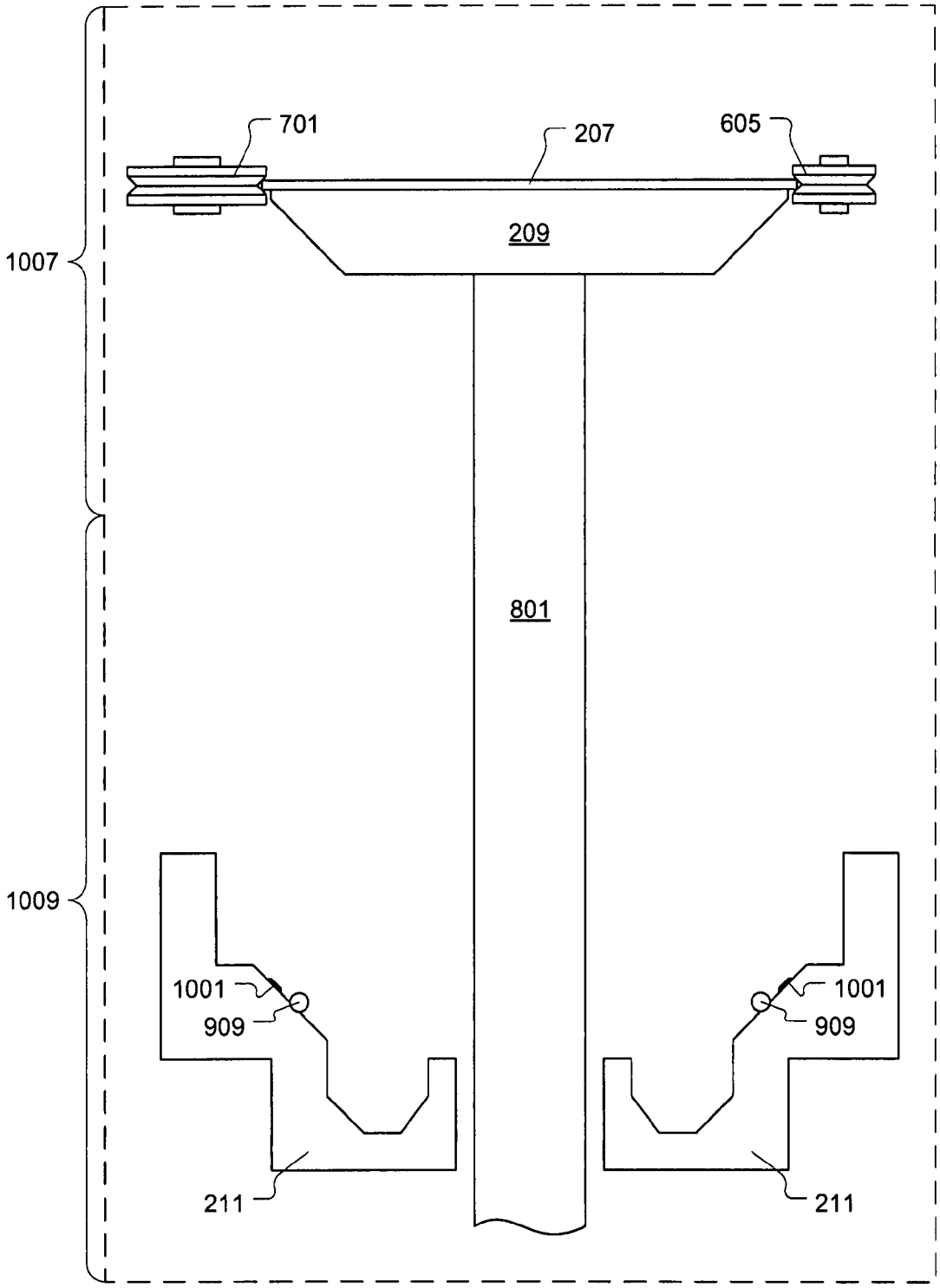
FIG. 6B is an illustration showing the platen raised to the wafer handoff position, in accordance with one embodiment of the present invention.

Following receipt of the wafer 207 within the chamber 100, the wafer 207 is moved to the lower region 1009 of the chamber 100 for processing. By way of the platen lift assembly 115 and shaft 801, the platen 209 is used to transport the wafer 207 from the upper region 1007 of the chamber 100 to the lower region 1009 of the chamber 207. FIG. 6B is an illustration showing the platen 209 raised to the wafer handoff position, in accordance with one embodiment of the present invention. Prior to raising the platen 209, a verification is made that the upper and lower prox heads 203/205 are in their home positions. Also, prior to raising the platen 209, the wafer 207 can be rotated as necessary by way of the drive rollers 701. The platen 209 is then raised to the wafer pickup position. At the wafer pickup position, the vacuum supply to the platen 209 is activated. The stabilizer roller 605 is moved to its retracted position away from the wafer 207. Also, the drive rollers 701 are moved to their retracted position away from the wafer 207. At this point the wafer 207 is vacuum chucked to the platen 209. In one embodiment, the vacuum pressure of the platen is verified to be less than a maximum user specified value. If the vacuum pressure of the platen is acceptable the wafer handoff process proceeds. Otherwise, the wafer handoff process aborts.

Figure 6C:
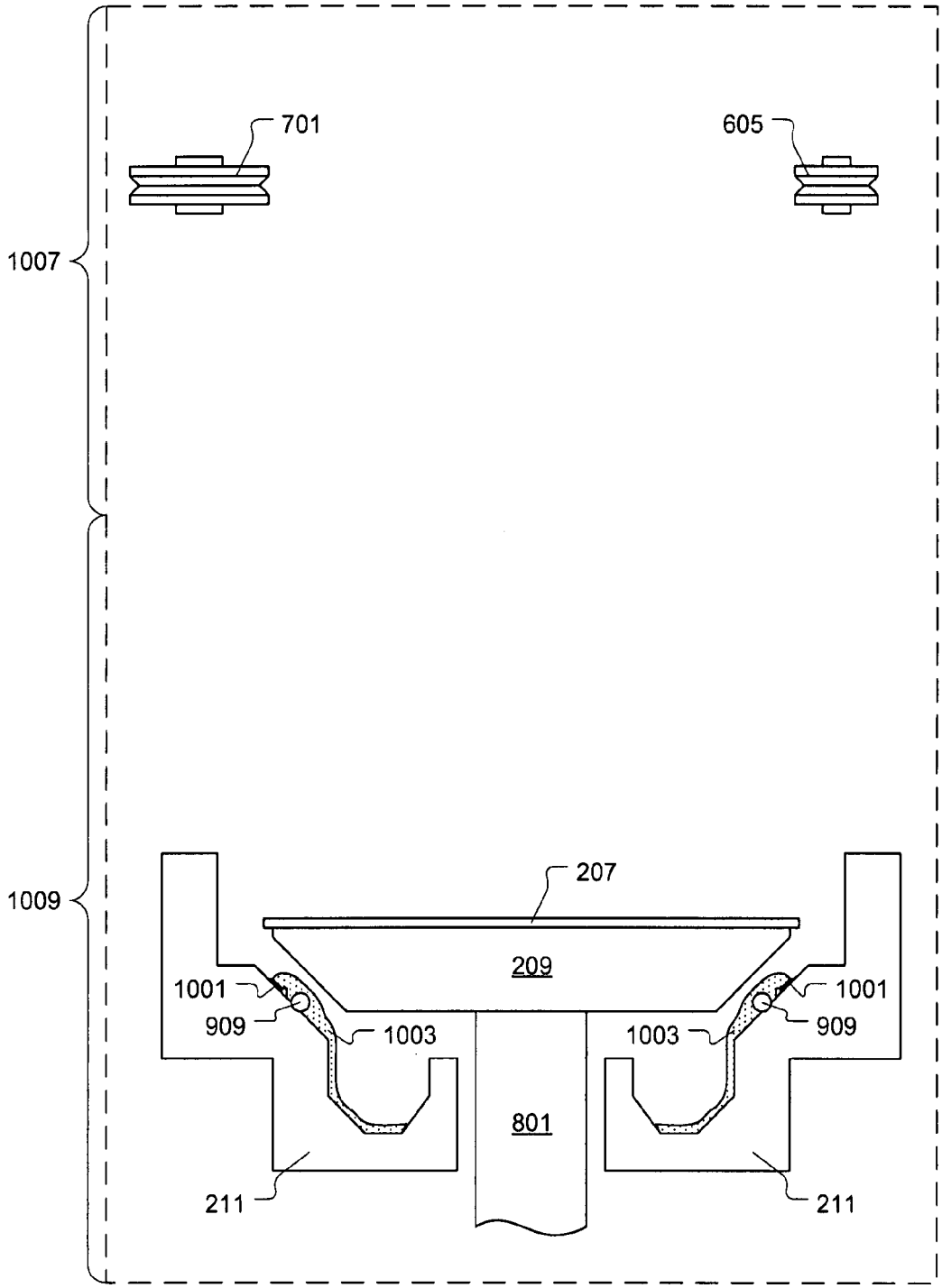
FIG. 6C is an illustration showing the platen in the hovering position just above the sealing position, in accordance with one embodiment of the present invention.

The platen 209 is heated to a user specified temperature, and the wafer 207 is held on the platen 209 for a user specified duration to allow the wafer 207 to heat up. The platen 209 with wafer thereon is then lowered to a hovering position just above a position at which the platen 209 would engage the fluid bowl seal 909, i.e., just above the sealing position. FIG. 6C is an illustration showing the platen 209 in the hovering position just above the sealing position, in accordance with one embodiment of the present invention. The distance between the platen 209 and the fluid bowl seal 909 in the hovering position is a user selectable parameter. In one embodiment, the distance between the platen 209 and the fluid bowl seal 909 in the hovering position is within a range extending from about 0.05 inch to about 0.25 inch.

When the platen 209 with the wafer 207 thereon is in the hovering position, the electroless plating process can commence. Prior to the electroless plating process, the FHS is operated to recirculate the electroless plating chemicals in a pre-mixed state. While the platen 209 is maintained in the hovering position, a flow of the electroless plating solution 1003 into the fluid bowl 211 by way of fluid dispense nozzles 1001 is initiated. The flow of electroless plating solution 1003 when the platen 209 is in the hovering position is referred to as a stabilizing flow. During the stabilizing flow, the electroless plating solution 1003 flows from the fluid dispense nozzles down between the platen 209 and fluid bowl seal 909 into the fluid bowl 211 drain basin. The fluid dispense nozzles 1001 are disposed in a substantially uniformly spaced manner about a periphery of the fluid bowl 211 so as to be positioned uniformly about a periphery of the underside of the platen 209 when the platen 209 is lowered to engage the fluid bowl seal 909. Also, each of the fluid dispense nozzles 1001 is positioned so that electroless plating solution 1003 dispensed therefrom is dispensed at a location below the wafer 207 held atop the platen 209.

The stabilizing flow allows the flow of electroless plating solution 1003 to each of the fluid dispense nozzles 1001 to stabilize prior to lowering of the platen 209 to engage the fluid bowl seal 909. The stabilizing flow continues until either a user specified amount of time has elapsed or until a user specified volume of electroless plating solution 1003 has been dispensed from the fluid dispense nozzles 1001. In one embodiment, the stabilizing flow continues for a period of time extending from about 0.1 second to about 2 seconds. Also, in one embodiment, the stabilizing flow continues until a volume of electroless plating solution 1003 extending from about 25 mL to about 500 mL has been dispensed from the fluid dispense nozzles 1001.

Figure 6D:
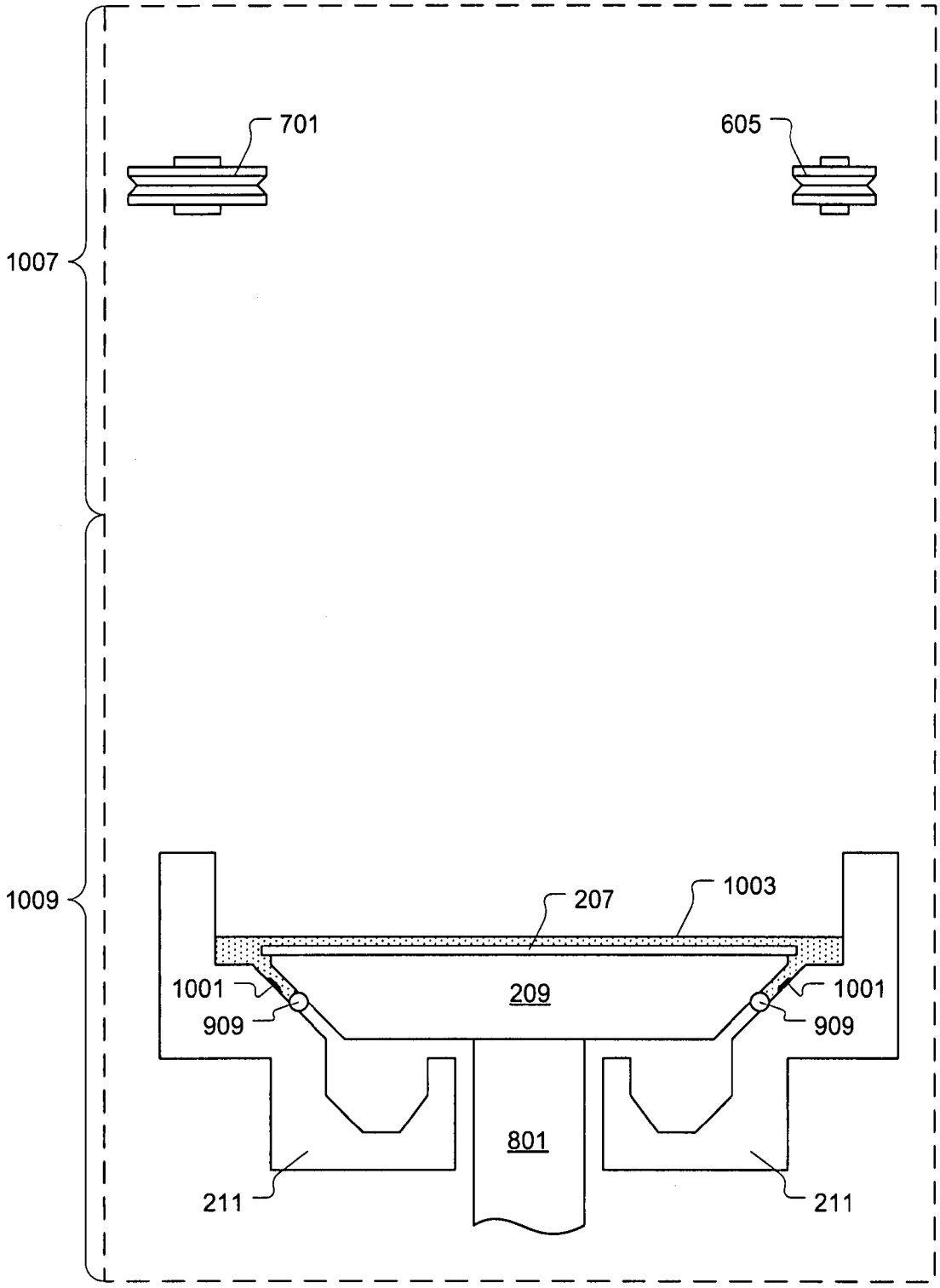
FIG. 6D is an illustration showing the platen lowered to engage the fluid bowl seal following completion of the stabilizing flow, in accordance with one embodiment of the present invention.

At the conclusion of the stabilizing flow, the platen 209 is lowered to engage the fluid bowl seal 909. FIG. 6D is an illustration showing the platen 209 lowered to engage the fluid bowl seal 909 following completion of the stabilizing flow, in accordance with one embodiment of the present invention. Upon engagement of the fluid bowl seal 909 by the platen 209, the electroless plating solution 1003 flowing from the fluid dispense nozzles 1001 will fill the space between the fluid bowl 211 and the platen 209 so as to well up and over the periphery of the wafer 207. Because the fluid dispense nozzles 1001 are substantially uniformly disposed about the periphery of the platen 209, the electroless plating solution 1003 will rise over the peripheral edge of the wafer in a substantially uniform manner so as to flow from the periphery of the wafer 207 toward the center of the wafer 207 in a substantially concentric manner.

In one embodiment, after the fluid bowl seal 909 has been engaged by the platen 209, an additional volume of electroless plating solution 1003 extending from about 200 mL to about 1000 mL is dispensed from the fluid dispense nozzles 1001. Dispensing of the additional electroless plating solution 1003 may take from about 1 second to about 10 seconds. Following the dispensing of the additional electroless plating solution 1003 so as to cover the entire wafer 207 surface with electroless plating solution 1003, a user defined period of time is allowed to elapse during which electroless plating reactions occur on the wafer surface.

Figure 6E:
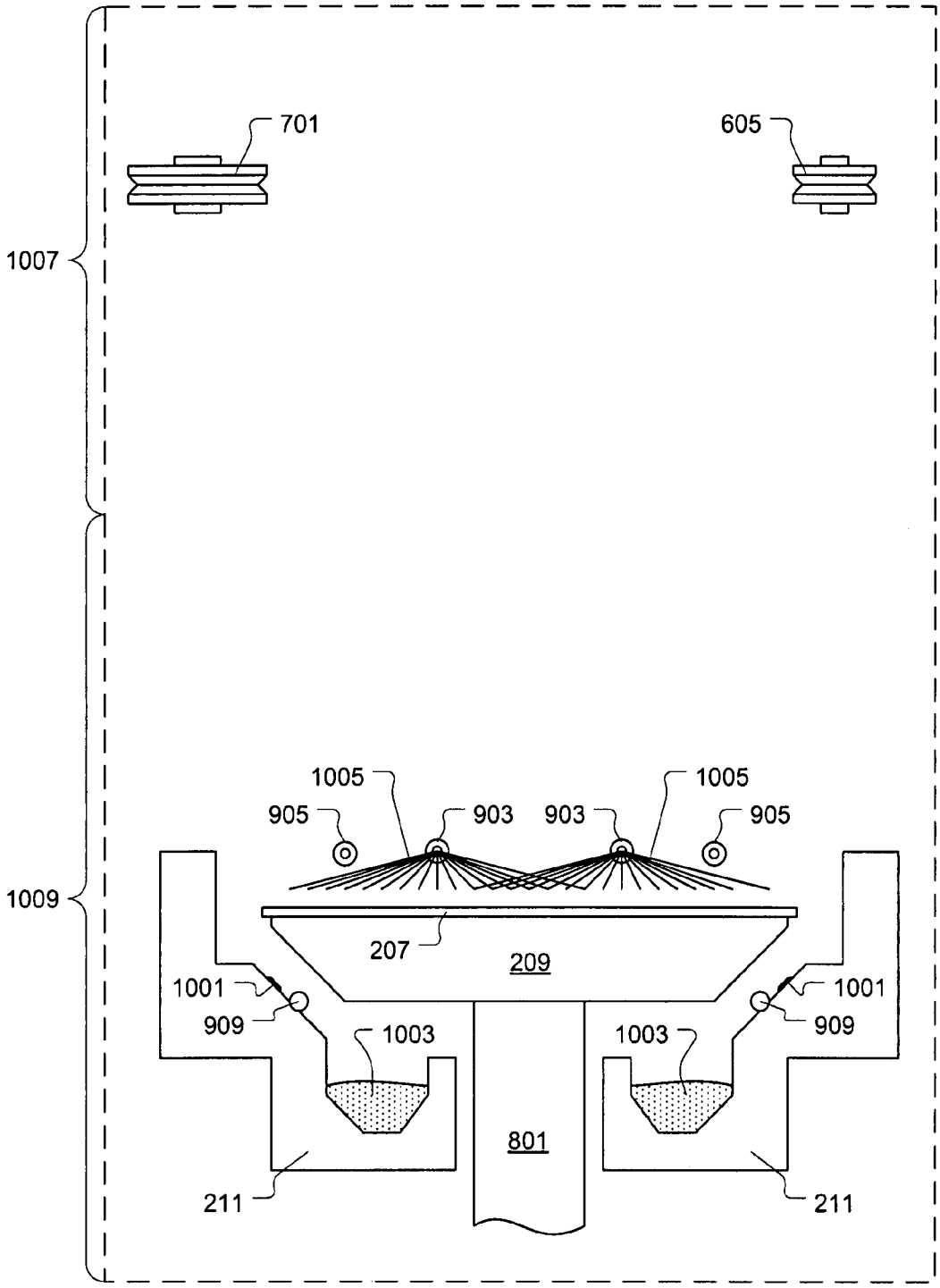
FIG. 6E is an illustration showing the wafer undergoing the rinsing process, in accordance with one embodiment of the present invention.

Immediately following the user defined time period for electroless plating reaction, the wafer 207 is subjected to a rinsing process. FIG. 6E is an illustration showing the wafer 207 undergoing the rinsing process, in accordance with one embodiment of the present invention. For the rinsing process, the platen 209 is raised to a wafer rinse position. When the platen 209 is raised, the seal between the platen 209 and the fluid bowl seal 909 is broken, and the majority of the electroless plating solution 1003 above the wafer 207 will flow to the fluid bowl 211 drain basin. The remaining electroless plating solution 1003 on the wafer 207 is removed by dispensing a rinse fluid 1005 from the rinse nozzles 903 onto the wafer 207. In one embodiment, the rinse fluid 1005 is deionized water (DIW). In one embodiment, the rinse nozzles 903 are fed from a single valve within the FHS. If necessary, the platen 209 can be moved during the rinsing process. Additionally, an inert gas such as nitrogen can be dispensed from the blow down nozzles 905 to blow liquid off of the wafer surface. The activation and duration of the rinse fluid 1005 flow and the inert blow down gas flow are user specified parameters.

Following the wafer rinsing process, the wafer 207 is moved to the wafer drying position, which is the same as the wafer handoff position. With reference back to FIG. 6B, the platen 209 is raised so as to position the wafer 207 proximate to the driver rollers 701 and stabilizer roller 605. Prior to raising the platen 209 from the rinsing position, a verification is made that the upper and lower prox heads 203/205 are in their home positions, the drive rollers 701 are fully retracted, and stabilizer roller 605 is fully retracted. Once the wafer is raised to the drying position, the drive rollers 701 are moved to their fully extended position, and the stabilizer roller 605 is moved to engage the edge of the wafer 207 so as to also cause the drive rollers 701 to engage the edge of the wafer 207. At this point the vacuum supply to the platen 209 is turned off and the platen is lowered slightly away from the wafer 207. Once the wafer 207 is verified as being securely held by the driver rollers 701 and stabilizer roller 605, the platen 209 is lowered to the fluid bowl sealing position, at which the platen 209 remains for the duration of the wafer processing within the chamber.

Figure 6F:
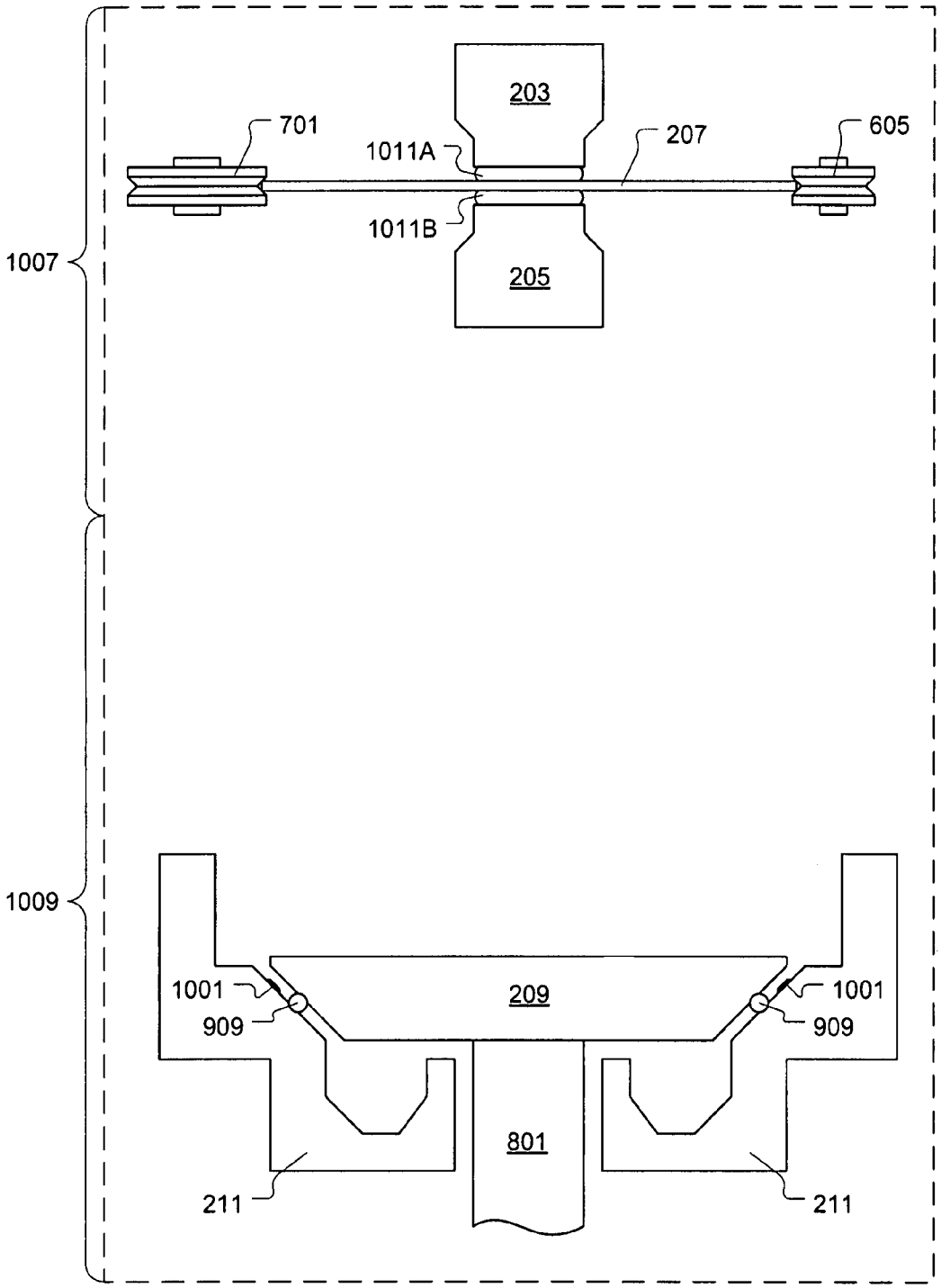
FIG. 6F is an illustration showing the wafer undergoing a drying process by way of the upper and lower prox heads, in accordance with one embodiment of the present invention.

FIG. 6F is an illustration showing the wafer 207 undergoing a drying process by way of the upper and lower prox heads 203/205, in accordance with one embodiment of the present invention. In one embodiment, flow to the upper and lower prox heads 203/205 is initiated with the prox heads at the prox head docking station 201. In another embodiment, the upper and lower prox heads 203/205 are moved to the center of the wafer 207 prior to initiating flow to the prox heads. To initiate flow to the prox heads 203/205, vacuum to both the upper and lower prox heads 203/205 is initiated. Then, following a user defined period, nitrogen and isopropyl alcohol (IPA) are flowed to the upper and lower prox heads 203/205 at a recipe defined flow rate, so as to form upper and lower drying meniscuses 1011A/1011B. If the flow is initiated at the prox head docking station 201, the upper and lower prox heads 203/205 are moved to the wafer center as the wafer is rotated. If the flow is initiated at the wafer center, the upper and lower prox heads 203/205 are moved to the wafer docking station 201 as the wafer is rotated.

Wafer rotation during the drying process is initiated at an initial rotation speed and adjusted as the prox heads 203/205 are scanned across the wafer. In one embodiment, during the drying process, the wafer will be rotated a rate extending from about 0.25 revolution per minute (rpm) to about 10 rpm. The wafer rotation speed will vary as a function of the prox head 203/205 radial position over the wafer. Also, a scanning speed of the upper and lower prox heads 203/205 is initiated at an initial scan speed and adjusted as the prox heads 203/205 are scanned across the wafer. In one embodiment, the prox heads 203/205 are scanned across the wafer at a rate extending from about 1 mm/sec to about 75 mm/sec. At the conclusion of the drying process, the upper and lower prox heads 203/205 are moved to the prox head docking station 201, the IPA flow to the prox heads 203/205 is stopped, the nitrogen flow to the prox heads 203/205 is stopped, and the vacuum supply to the prox heads 203/205 is stopped.

During the drying process, the upper and lower prox heads 203/205 are positioned in close proximity to a top surface 207A and a bottom surface 207B of the wafer 207, respectively. Once in this position, the prox heads 203/205 may utilize the IPA and DIW source inlets and a vacuum source outlet(s) to generate wafer processing meniscuses 1011A/1011B in contact with the wafer 207 which are capable of applying and removing fluids from the top and bottom surfaces of the wafer 207. The wafer processing meniscuses 1011A/1011B may be generated in accordance with the descriptions provided with regard to FIG. 7, where IPA vapor and DIW are input into the region between the wafer 207 and the prox heads 203/205. At substantially the same time the IPA and DIW is input, a vacuum may be applied in close proximity to the wafer surface to output the IPA vapor, the DIW, and the fluids that may be on a wafer surface. It should be appreciated that although IPA is utilized in the exemplary embodiment, any other suitable type of vapor may be utilized such as any suitable alcohol vapor, organic compounds, hexanol, ethyl glycol, etc. that may be miscible with water. Alternatives to IPA include but are not limited to the following: diacetone, diaceton alcohol, 1-methoxy-2-propanol, ethylglycol, methylpyrrolidon, ethyllactate, 2-butanol. These fluids may also be known as surface tension reducing fluids. The surface tension reducing fluids act to increase the surface tension gradient between the two surfaces (i.e., between the prox heads 203/205 and the surface of the wafer 207.

The portion of the DIW that is in the region between the prox heads 203/205 and the wafer 207 is the dynamic liquid meniscus 1011A/1011B. It should be appreciated that as used herein, the term "output" can refer to the removal of fluid from a region between the wafer 207 and a particular prox head 203/205, and the term "input" can be the introduction of fluid to the region between the wafer 207 and the particular prox head 203/205.

Figure 7:
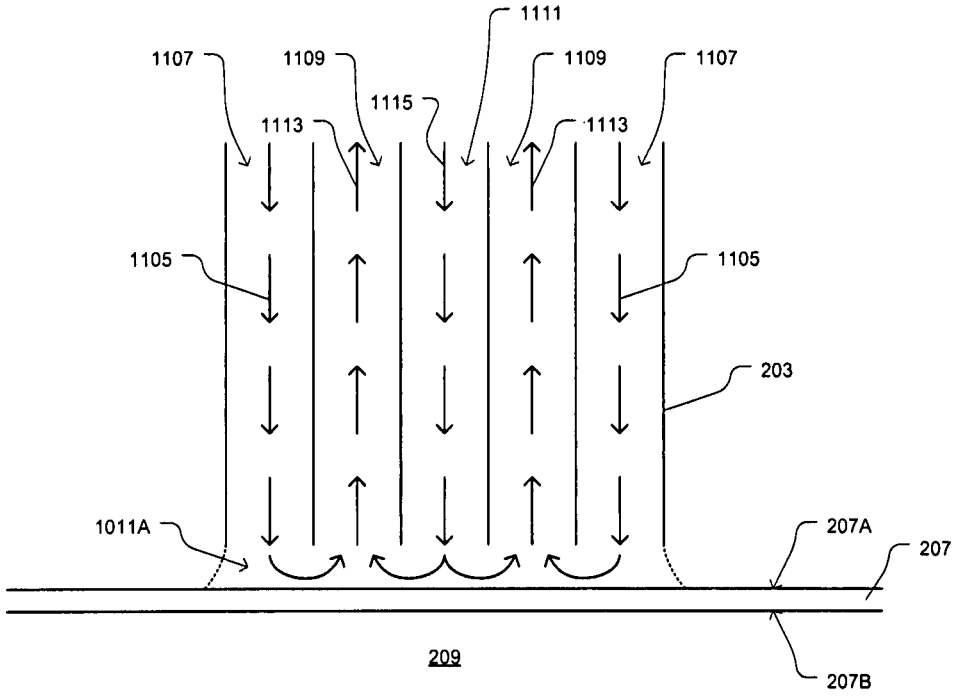
FIG. 7 is an illustration showing an exemplary process that may be conducted by a prox head, in accordance with one embodiment of the present invention.

FIG. 7 is an illustration showing an exemplary process that may be conducted by a prox head 203/205, in accordance with one embodiment of the present invention. Although FIG. 7 shows a top surface 207A of the wafer 207 being processed, it should be appreciated that the process may be accomplished in substantially the same way for a bottom surface 207B of the wafer 207. While FIG. 7 illustrates a substrate drying process, many other fabrication processes (e.g., etching, rinsing, cleaning, etc.) may also be applied to the wafer surface in a similar manner. In one embodiment, a source inlet 1107 may be utilized to apply isopropyl alcohol (IPA) vapor toward the top surface 207A of the wafer 207, and a source inlet 1111 may be utilized to apply deionized water (DIW) toward the top surface 207A. In addition, a source outlet 1109 may be utilized to apply vacuum to a region in close proximity to the surface 207A to remove fluid or vapor that may located on or near the surface 207A.

It should be appreciated that any suitable combination of source inlets and source outlets may be utilized as long as at least one combination exists where at least one of the source inlet 1107 is adjacent to at least one of the source outlet 1109 which is in turn adjacent to at least one of the source inlet 1111. The IPA may be in any suitable form such as, for example, IPA vapor where IPA in vapor form is inputted through use of a nitrogen carrier gas. Moreover, although DIW is utilized herein, any other suitable fluid may be utilized that may enable or enhance the substrate processing such as, for example, water purified in other ways, cleaning fluids, and other processing fluids and chemistries. In one embodiment, an IPA inflow 1105 is provided through the source inlet 1107, a vacuum 1113 is applied through the source outlet 1109, and DIW inflow 1115 is provided through the source inlet 1111. If a fluid film resides on the wafer 207, a first fluid pressure may be applied to the substrate surface by the IPA inflow 1105, a second fluid pressure may be applied to the substrate surface by the DIW inflow 1115, and a third fluid pressure may be applied by the vacuum 1113 to remove the DIW, IPA, and the fluid film on the substrate surface.

It should be appreciated that by controlling the fluid flow amount onto the wafer surface 207A and by controlling the vacuum applied, the meniscus 1011A may be managed and controlled in any suitable manner. For example, in one embodiment, by increasing the DIW flow 1115 and/or decreasing the vacuum 1113, the outflow through the source outlet 1109 may be nearly all DIW and the fluids being removed from the wafer surface 207A. In another embodiment, by decreasing the DIW flow 1115 and/or increasing the vacuum 1113, the outflow through the source outlet 1109 may be substantially a combination of DIW and IPA as well as fluids being removed from the wafer surface 207A. Following the wafer drying process, the wafer 207 can be returned to the external module, e.g., MTM.

Figure 8:
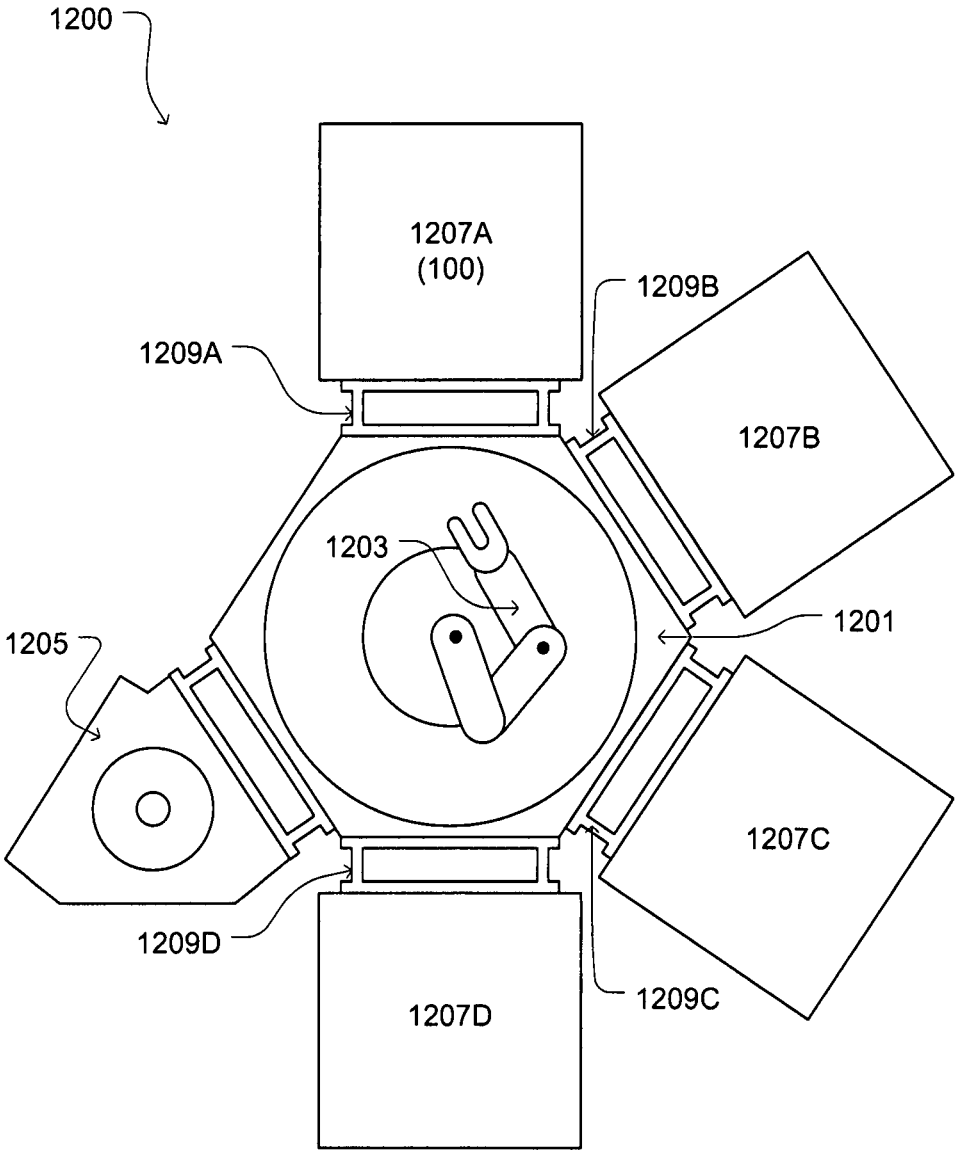
FIG. 8 is an illustration showing a cluster architecture, in accordance with one embodiment of the present invention.

FIG. 8 is an illustration showing a cluster architecture 1200, in accordance with one embodiment of the present invention. The cluster architecture 1200 includes a controlled ambient transfer module 1201, i.e., a managed transfer module (MTM) 1201. The MTM 1201 is connected to a load lock 1205 by way of a slot valve 1209E. The MTM 1201 includes a robotic wafer handling device 1203, i.e., end effector 1203, that is capable of retrieving a wafer from the load lock 1205. The MTM 1201 is also connected with a number of process modules 1207A, 1207B, 1207C, and 1207D through respective slot valves 1209A, 1209B, 1209C, and 1209D. In one embodiment, the processing modules 1207A-1207D are controlled ambient wet processing modules. The controlled ambient wet processing modules 1207A-1207D are configured to process a surface of a wafer in a controlled inert ambient environment. The controlled inert ambient environment of the MTM 1203 is managed such that an inert gas is pumped into the MTM 1203, and oxygen is purged out of the MTM 1203. In one embodiment, the electroless plating chamber 100 can be connected to the MTM 1203 as a processing module. For example, FIG. 8 shows that processing module 1207A is actually the dry-in/dry-out electroless plating chamber 100.

By removing all or most of the oxygen from the MTM 1203 and replacing it with an inert gas, the MTM 1203 will provide a transition environment which does not expose a just-processed wafer before or after an electroless plating process is performed thereon in the chamber 100. In specific embodiments, the other processing modules 1207B-1207D may be electroplating modules, electroless plating modules, dry-in/dry-out wet process modules, or other types of modules that will enable the application, formation, removal, or deposition of a layer on top of a wafer surface or feature, or other types of wafer processing.

In one embodiment, monitoring and control of the chamber 100 and interfacing equipment, e.g., FHS, is provided through a graphical user interface (GUI) operating on a computer system that is remotely located with respect to the processing environment. Various sensors within the chamber 100 and interfacing equipment are connected to provide a read out in the GUI. Each electronically actuated control within the chamber 100 and interfacing equipment can be actuated through the GUI. The GUI is also defined to display warnings and alarms based on various sensor readings within the chamber 100 and interfacing equipment. The GUI is further defined to indicate a process state and system conditions.

The chamber 100 of the present invention incorporates a number of advantageous features. For example, the implementation of upper and lower prox heads 203/205 within the chamber 100 provides the chamber 100 with a dry-in/dry-out wafer electroless plating process capability. The dry-in/dry-out capability enables the chamber 100 to interface with the MTM, enables tighter control of chemical reactions on the wafer surface, and prevents the carrying of chemicals outside of the chamber 100.

The double walled configuration of the chamber 100 also provides advantages. For example, the outer structural wall provides for strength and interface precision, while the inner liner provides a chemical boundary to keep chemicals from reaching the outer structural wall. Because the outer structure wall is responsible for providing the vacuum boundary, the inner liner does not have to be capable of providing a vacuum boundary, thus enabling the inner wall to be fabricated from inert materials such as plastic. Additionally, the inner wall is removable to facilitate chamber 100 cleaning or re-equipping. Also, the strength of the outer wall enables a decrease in time required to achieve an inert ambient condition within the chamber 100.

The chamber 100 provides for control of ambient conditions within the chamber 100. Use of an inert ambient condition during drying enables creation of a surface tension gradient (STG) which in turn enables the prox head processes. For example, a carbon dioxide ambient condition can be established within the chamber 100 to assist with creation of STG during the prox head drying process. The integration of STG drying, i.e., prox head drying, within a wet process chamber, i.e., within an electroless plating chamber, enables a multi-stage process capability. For example, the multi-stage process may include a pre-clean operation by way of the prox heads in the upper region of the chamber, an electroless plating process in the lower region of the chamber, and post-clean and drying operations by way of the prox heads in the upper region of the chamber.

Furthermore, the chamber 100 is configured to minimize an amount of required electroless plating solution, thereby enabling use of single-shot chemistry, i.e., single use and discard chemistry. Also, a point of use mixing approach is implemented to control electrolyte activation before deposition on wafer. This is accomplished by use of the mixing manifold which incorporates an injector tube, where the activating chemistry is injected into a flow stream of chemicals surrounding the injector tube, as close as possible to the fluid bowl dispense locations. This increases reactant stability, and reduces defects. Additionally, the quenching rinse capability of the chamber 100 provides for greater control over electroless plating reaction time on the wafer. The chamber 100 is further configured to be easily cleaned by introducing a "backflush" chemistry into the limited volume of the fluid bowl. The "backflush" chemistry is formulated to remove metal contaminants that may be introduced by the electroless plating solution. In other embodiments, the chamber 100 can be further configured to incorporate various types of in-situ metrology. Also, in some embodiments, the chamber 100 can include radiant or absorptive heating sources to initiate electroless plating reactions on the wafer.

Operations of the chamber 100 are supported by a fluid handling system (FHS). In one embodiment, the FHS is defined as a separate module from the chamber 100 and is connected in fluid communication with various components within the chamber 100. The FHS is defined to service the electroless plating process, i.e., the fluid bowl dispense nozzles, rinse nozzles, and blowdown nozzles. The FHS is also defined to service the upper and lower prox heads 203/205. A mixing manifold is disposed between the FHS and the supply line that services each of the fluid dispense nozzles within the fluid bowl 211. Thus, the electroless plating solution that flows to each of the fluid dispense nozzles within the fluid bowl 211 is pre-mixed prior to reaching the fluid bowl 211.

Fluid supply lines are disposed to fluidly connect the mixing manifold to the various fluid dispense nozzles within the fluid bowl 211, such that the electroless plating solution will flow into the fluid bowl 211 from each fluid dispense nozzle in a substantially uniform manner, e.g., at a substantially uniform flow rate. The FHS is defined to enable a nitrogen purge of the fluid supply lines disposed between the mixing manifold and the fluid dispense nozzles within the fluid bowl 211, so as to enable clearing of the fluid supply lines of electroless plating solution. The FHS is also defined to support the wafer rinsing process by providing rinsing fluid to each of the rinse nozzles 903 and by providing inert gas to each of the blowdown nozzles 905. The FHS is defined to enable manual setting of a pressure regulator to control the liquid pressure emanating from the rinse nozzles 903.

Figure 9:
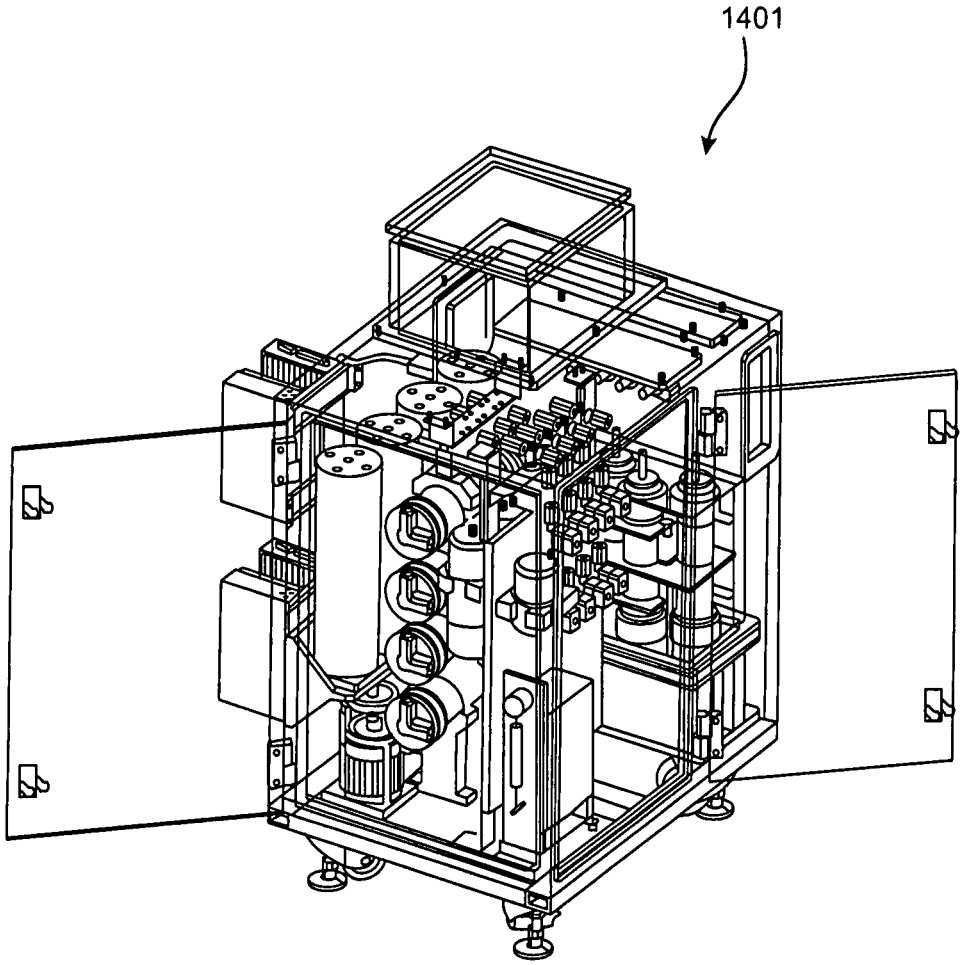
FIG. 9 is an illustration showing an isometric view of the chemical FHS, in accordance with one embodiment of the present invention.
Figure 10:
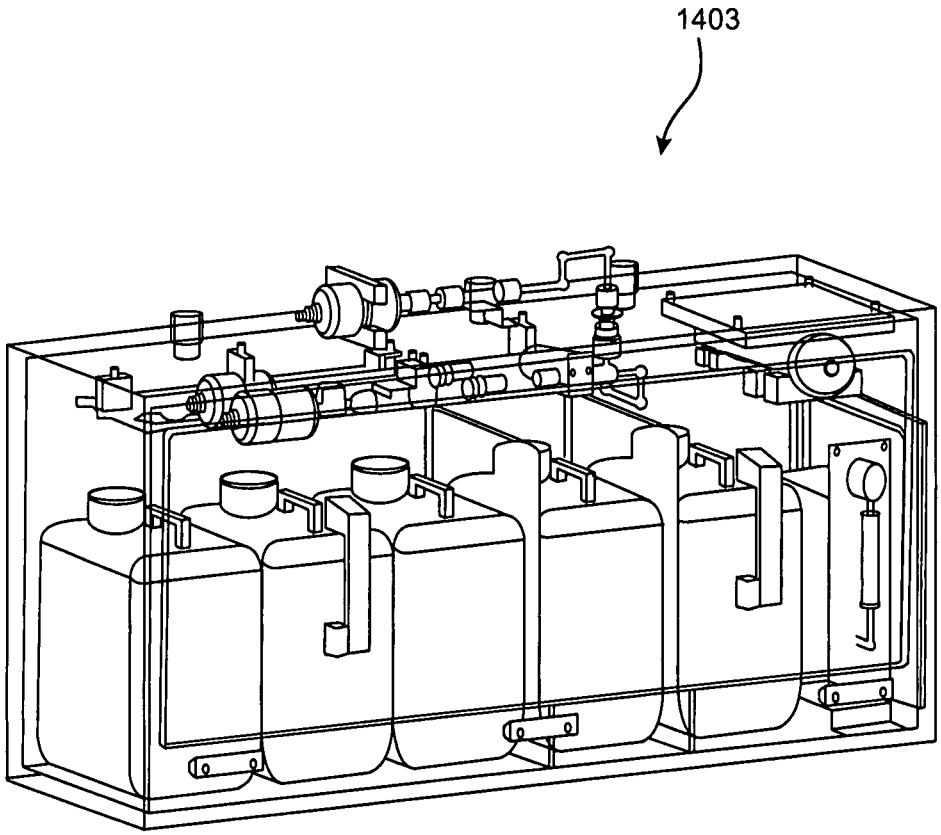
FIG. 10 is an illustration showing an isometric view of the chemical supply FHS, in accordance with one embodiment of the present invention.
Figure 11:
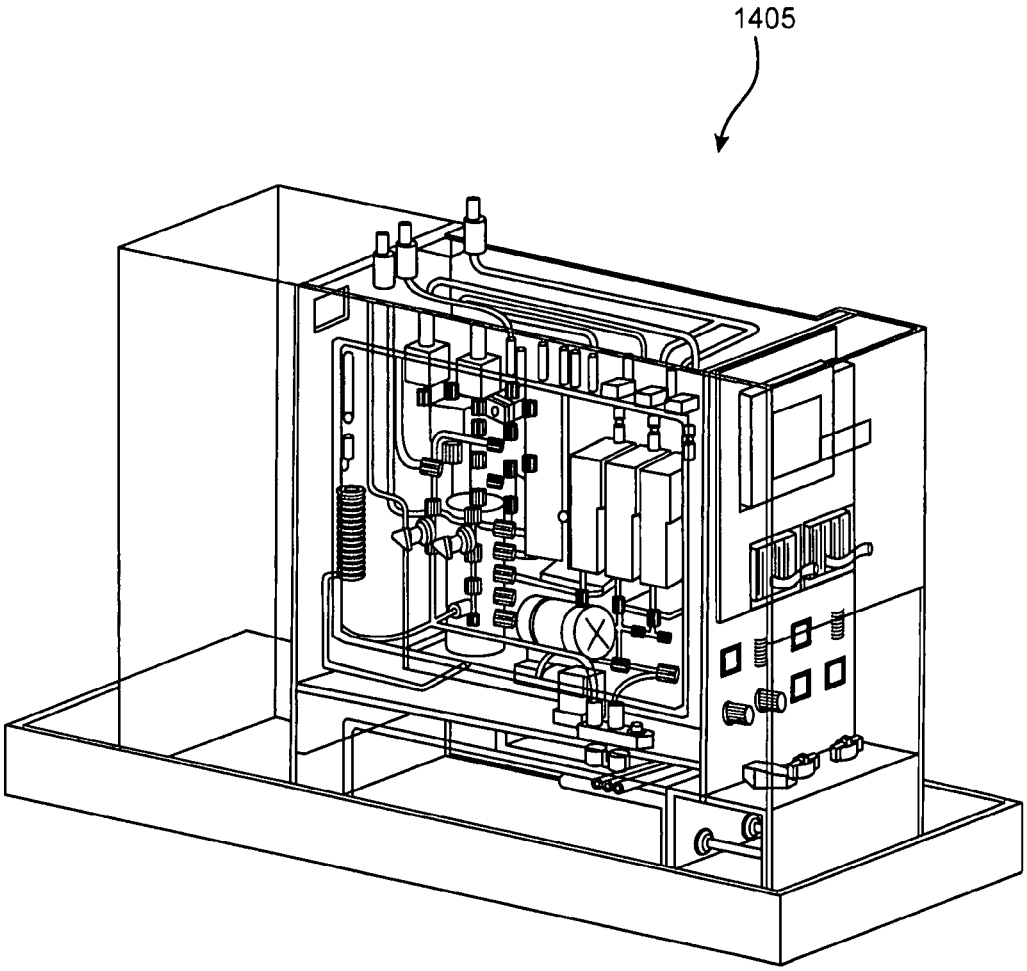
FIG. 11 is an illustration showing an isometric view of the rinse FHS, in accordance with one embodiment of the present invention.

In one embodiment, the FHS includes three primary modules: 1) a chemical FHS 1401, 2) a chemical supply FHS 1403, and 3) a rinse FHS 1405. FIG. 9 is an illustration showing an isometric view of the chemical FHS 1401, in accordance with one embodiment of the present invention. FIG. 10 is an illustration showing an isometric view of the chemical supply FHS 1403, in accordance with one embodiment of the present invention. FIG. 11 is an illustration showing an isometric view of the rinse FHS 1405, in accordance with one embodiment of the present invention.

In one embodiment, the chemical FHS 1401 is defined to include four fluid recirculation loops 1407 for pre-conditioning a fluid prior to supplying the fluid to the chamber 100, and for controlling the supply of the fluid to the chamber 100. In one embodiment, three of the recirculation loops 1407 are utilized to pre-condition and control the supply of processing chemicals to the chamber 100, and the fourth recirculation loop 1407 is utilized to pre-condition and control supply of deionized water (DIW) to the chamber 100. It should be appreciated that in other embodiments, the chemical FHS 1401 can include a different number, i.e., fewer than four or more than four, of fluid recirculation loops 1407, and the various recirculation loops 1407 can be utilized to supply different types of fluids to the chamber 100.

Figure 12:
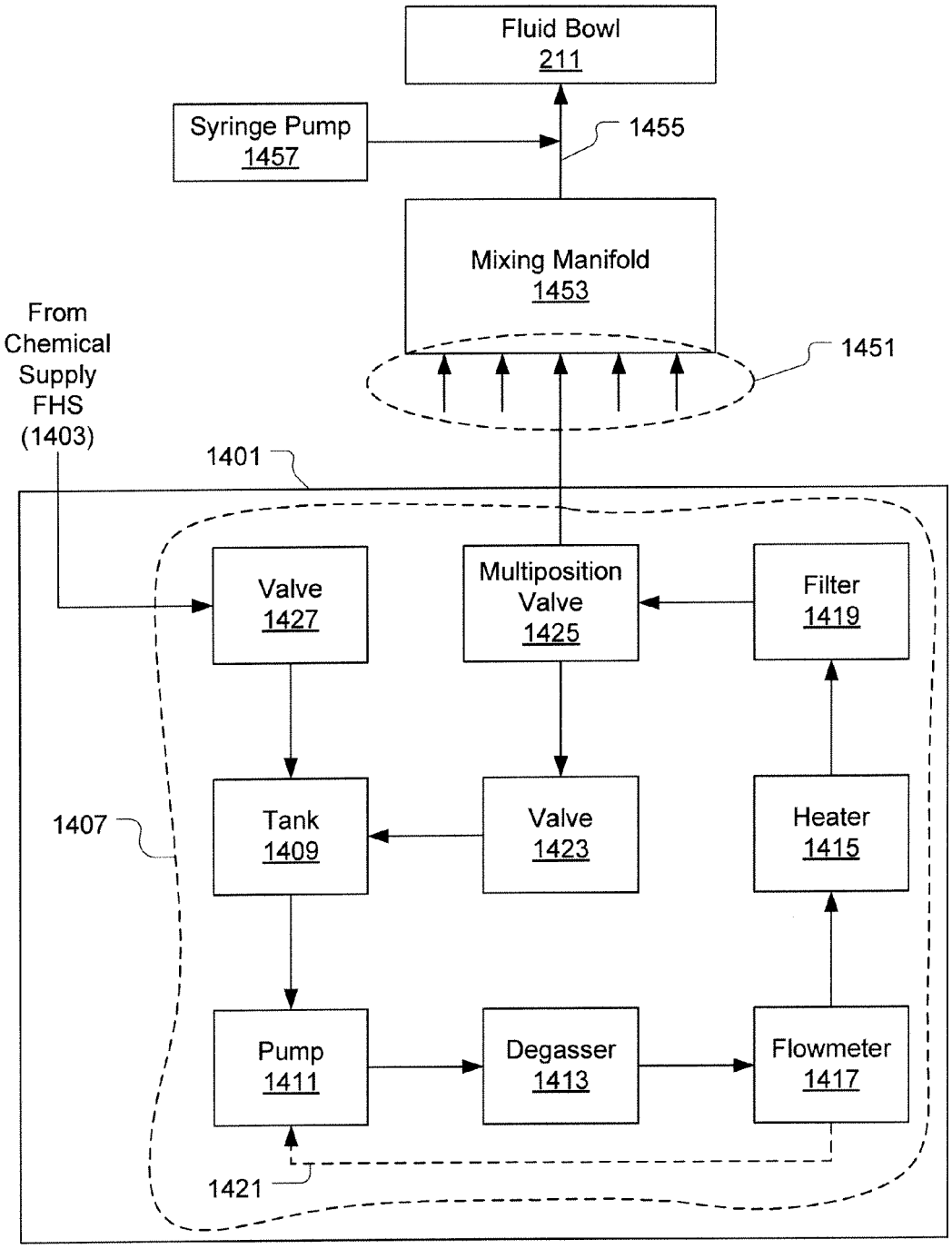
FIG. 12 is an illustration showing a recirculation loop of the chemical FHS, in accordance with one embodiment of the present invention.

FIG. 12 is an illustration showing a recirculation loop 1407 of the chemical FHS 1401, in accordance with one embodiment of the present invention. The recirculation loop 1407 includes a surge tank 1409, a pump 1411, a degasser 1413, a heater 1415, a flowmeter 1417, and a filter 1419. The pump 1411 is used to provide the motive force for both recirculating the fluid and dispensing the fluid in the fluid bowl 211. In one embodiment, the pump 1411 is a magnetically levitated centrifugal pump. In a recirculation mode, the pump 1411 controls the flow in the recirculation loop 1407 to comply with a user defined flow rate. The pump 1411 reads a current output from the flowmeter 1417, as indicated by arrow 1421, and adjusts its speed to maintain a substantially constant flow rate. In one embodiment, the flow rates within the recirculation loop 1407 will vary between 500 mL/min to 6000 mL/min. The pump 1411 speed will gradually increase as the filter 1419 becomes clogged. Therefore, the pump 1411 speed can be monitored to determine when the filter 1419 needs to be changed. A filter 1419 warning signal can be provided when the monitored pump 1411 speed exceeds a user specified pump speed threshold. The pump 1411 speed can also be controlled directly.

In one embodiment, the heater 1415 is a resistive heater defined to heat the fluid as it is circulated through the recirculation loop 1407. The degasser 1413 is used to remove gas from the fluid as it is circulated through the recirculation loop 1407. The degasser 1413 has vacuum on one side of a gas permeable membrane over which the fluid is circulated. Thus, gases dissolved in the fluid pass through the membrane out of the fluid.

A multiposition valve 1425 is provided to control whether the fluid is recirculated through the recirculation loop 1407 or directed to the mixing manifold for ultimate provision to the fluid bowl 211. In one embodiment, a manual needle valve 1423 is provided to enable matching of the pressure drop from the multiposition valve 1425 to the surge tank 1409 with the pressure drop from the multiposition valve 1425 to the fluid bowl 211. This pressure drop matching prevents a significant spike in flowrate when the multiposition valve 1425 is activated to direct the fluid to the fluid bowl 211.

The recirculation loop 1407 can be operated in three modes: 1) startup mode, 2) fluid heating mode, and 3) pre-dispense/dispense mode. In startup mode, it is assumed that the surge tank 1409 starts completely empty. The goal of the startup mode is to prime the pump 1411 and fill the recirculation loop 1407. Before the pump 1411 is started, the surge tank 1409 should be filled to a level that will prevent gas from being pulled into the fluid stream. To fill the surge tank 1409, a valve 1427 is activated to allow chemical from the chemical supply FHS 1403 to enter the surge tank 1409. The pump 1411 is then started at a slow speed. The pump 1411 speed is gradually increased as additional chemical is supplied to the tank through the valve 1427.

When fluid is added to the recirculation loop 1407, either as a result of system startup or because fluid was added during normal operation, the fluid should be heated by the heater 1415 during the fluid heating mode. In normal operation, it is expected that about 200 mL will be added to the recirculation loop 1407 during a refill cycle. It is expected that up to 3 L can be added during startup. In one embodiment, an optimum flowrate for heating the fluid is about 2 L/min. The flowrate of fluid through the recirculation loop 1407 can be controlled to the optimum flowrate during the heating mode. It is expected to take about 150 seconds to bring about 200 mL of fluid from room temperature up to about 60° C.

Prior to dispensing the fluid to the fluid bowl 211 in the pre-dispense/dispense mode, the flowrate of fluid through the recirculation loop 1407 should be set to the flow rate expected during dispensing of the fluid to the fluid bowl 211. In one embodiment, the flow rates used for dispensing fluid to the fluid bowl 211 can vary from about 0.25 L/min to about 2.4 L/min. This correlates to about 21.6 mL to about 200 mL of fluid being dispensed to the fluid bowl 211 during a 5 second dispense period. It should take about 20 seconds for the flowrate in the loop to stabilize when being adjusted in this range. Dispensing of fluid from the recirculation loop 1407 to the fluid bowl 211, by way of the mixing manifold, is achieved by activating the multiposition valve 1425 to direct fluid to the fluid bowl 211 for an appropriate dispense period. The multiposition valve 1425 of each recirculation loop 1407 should be actuated at substantially the same time to ensure that the appropriate mixture of chemicals is provided to the fluid bowl 211. As previously discussed with regard to FIG. 6C, an amount of fluid is allowed to flow directly into the drain basin of the fluid bowl 211 prior to engagement of the platen 209 with the fluid bowl seal 909 to ensure that the flow of fluid from the chemical FHS 1401 to the fluid bowl is stabilized.

The chemical FHS also includes a syringe pump 1457 for injecting a fourth chemical into the fluid supply just before the fluid bowl 211. In one embodiment, the syringe pump 1457 is filled prior to initiating the fluid dispense mode of operation. The syringe pump 1457 includes a rotary valve that allows different ports to be opened to the syringe. In one embodiment, the syringe pump 1457 is a positive displacement pump and has a 50 mL maximum charge. The syringe pump 1457 is filled by setting the rotary valve so the syringe is opened to a desired chemical supply. The syringe pump 1457 is dispensed by setting the rotary valve so the syringe pump 1457 is opened to the fluid stream as it flows to the fluid bowl 211. In one embodiment, the dispense rate from the syringe pump 1457 can vary from about 10 mL/min to about 1000 mL/min. It should be appreciated that the syringe pump 1457 discussed above is but one embodiment of a number of possible embodiments. Additionally, it should be understood that the dispense of chemicals 1-3, DIW, and chemical 4 are coordinated to prevent imprecise chemical mixtures from reaching the fluid bowl 211 and wafer 207.

With further regard to FIG. 12, it should be understood that the recirculation loop 1407 is defined within the chemical FHS 1401 to supply one of a number of chemicals in a controlled manner to one of a number of fluid inputs 1451 of a mixing manifold 1453. The mixing manifold 1453 includes fluid output connected to a fluid supply line 1455, which is connected to supply an electroless plating solution to the fluid bowl 211 within the chamber 100. The mixing manifold 1453 is defined to mix the number of chemicals received from the chemical FHS 1401 so to form the electroless plating solution. In one embodiment, the mixing manifold 1453 is disposed as close as possible to the chamber 100 so as to minimize a length of the fluid supply line 1455, through which mixed electroless plating solution flows.

The chemical supply FHS 1403 is defined to supply the various chemicals to the chemical FHS 1401 from respective chemical supply tanks. In one embodiment, the various chemicals are pressurized for delivery to the chemical FHS 1401. The pressures in the various chemical supply tanks are controlled by pressure regulators. Also, each chemical supply tank has a fluid level sensor. Each fluid level sensor can be monitored to verify that sufficient chemical is present in the chemical supply tank to proceed with the process to be performed within the chamber 100. The chemical supply FHS 1403 includes the ability to deliver a fifth chemical to the fluid bowl. In one embodiment, the fifth chemical is defined as a cleaning chemistry for cleaning the fluid bowl 211. The cleaning chemistry is used to prevent or remove plating deposits in the electroless plating solution delivery lines and fluid bowl 211. The cleaning chemistry may or may not be pressurized. In one embodiment, the cleaning chemistry is delivered by a syringe pump present in the chemical supply FHS 1403.

The rinse FHS 1405 includes a portion for IPA generation and delivery and a portion for rinsing fluid delivery and extraction from the chamber 100. An IPA system is housed in a separate stainless steel enclosure of the rinse FHS 1405 to keep the flammable IPA from heaters and other chemicals within the overall FHS system. The rinse FHS 1405 enclosure also includes ports for facilities entry and waste exit. In one embodiment, facilities enter and waste exits the bottom of the rinse FHS 1405 enclosure. Also, in one embodiment, an upper portion of the rinse FHS 1405 enclosure includes vacuum tanks, evacuation pumps, and flow controllers associated with the upper and lower prox heads 203/205.

The IPA system supports generation of IPA vapor and supply of IPA vapor to the upper and lower prox heads 203/205. A nitrogen/IPA supply line is connected to supply IPA vapor to each of the upper and lower prox heads 203/205. In one embodiment, independent control of the IPA vapor flow and nitrogen flow is provided for each of the upper and lower prox heads 203/205. In one embodiment, two on-board tanks contain IPA, wherein each tank is defined to have a capacity of 2 L with 1 L of usable volume. These two tanks are used in an alternate manner to supply IPA to a vaporizer system. As one tank supplies IPA, the other tank can be replenished. Sensors are utilized to monitor fluid levels within each tank. Also, each tank is equipped with an overpressure relief valve, which will vent into an exhaust.

In one embodiment, a single vaporizer system services both the upper and lower prox heads 203/205. Liquid IPA is dispensed from one of the tanks through a liquid mass flow controller at a mass flowrate up to 30 g/min. A nitrogen carrier gas is dispensed through a mass flow controller at a flowrate up to 30 SLPM (standard liters per minute), and is combined with the IPA and then injected into the vaporizer system. Hot IPA vapor leaving the vaporizer system is mixed with a post vaporizer nitrogen dilutor to dilute the concentration of IPA within the hot vapor. The amount of post vaporizer nitrogen is controlled by a mass flow controller at a flowrate up to 200 SLPM. The IPA vapor is then delivered to the upper and lower prox heads 203/205.

As previously mentioned, the amount of IPA vapor flow to each prox head 203/205 can be controlled independently. In one embodiment, a rotometer is used to control the flow of IPA to each prox head 203/205. The rotometer allows the user to adjust the ratio of flow going to the upper and lower prox heads 203/205. In one embodiment, the various nitrogen flow rates are monitored via the mass flow controllers and are reported to an operator. A warning or alarm can be triggered by the nitrogen flow rate being too low or too high relative to a user defined trigger point.

The fluid delivery and extraction features of the rinse FHS 1405 support getting liquid to and from the prox heads 203/205. Fluid deliver to the prox heads 203/205 includes supplying a flow of DIW to the upper and lower prox heads 203/205. In one embodiment, separate flow controllers are used to control delivery of DIW to inner and outer portions, respectively, of a meniscus formed by the upper prox head 203. In one embodiment, each of these flow controllers is operated to control DIW flow within a range extending from about 200 mL/min to about 1250 mL/min. The DIW flow rate is settable both manually and by recipe. Also, valves are provided to activate DIW flow to each portion of the meniscus for the upper prox head 203. In one embodiment, DIW flow is provided to a single zone in the meniscus formed by the lower prox head 205. In one embodiment, a flow controller is used to control flow of DIW to the lower prox head 205 within a range extending from about 200 mL/min to about 1250 mL/min.

The rinse FHS 1405 provides for removal of fluid from the upper and lower prox heads 203/205 through a set of vacuum tanks and vacuum generators. In one embodiment, the rinse FHS 1405 includes a total of four vacuum generators and respective vacuum tanks. More specifically, a vacuum tank/generator combination is provided for each of the upper prox head 203 outer zone, the upper prox head 203 inner zone, the lower prox head 205, and the drive rollers 701 and stabilizer roller 605. Valves are used to control the vacuum supply to the upper prox head 203, lower prox head 205, and rollers 701/605, respectively. These valves are operated to generate and control the vacuum in the vacuum tanks. Valves are also used to activate the vacuum at each of the upper prox head 203, lower prox head 205, and rollers 701/605. Also, sensors are provided to monitor the fluid level within each vacuum tank.

Drain pumps are also provided to pump out the vacuum tanks. In one embodiment, the drain pumps are pneumatically actuated diaphragm pumps. Each tank has a drain valve to enable independent control of the pumping of the tank by its drain pump. Additionally, sensors are provided to monitor the pressure within each vacuum tank. In one embodiment, each vacuum tank is operated at a pressure within a range extending from about 70 mmHg to about 170 mmHg. A pressure alarm can also be provided to notify if the pressure within the vacuum tank is out of operating range.

The chamber 100 includes a number of fluid drain locations. In one embodiment, three separate fluid drain locations are provided within the chamber 100: 1) a primary drain from the fluid bowl 211, 2) a chamber floor drain, and 3) a platen vacuum tank drain. Each of these drains is connected to a common facility drain provided within the rinse FHS 1405. The fluid bowl 211 drain is plumbed from the fluid bowl 211 to a chamber drain tank. A valve is provided to control the draining of fluid from the fluid bowl 211 to the chamber drain tank. In one embodiment, this valve is configured to open when fluid is present within the drain line that connects the fluid bowl 211 to the chamber drain tank.

A chamber floor drain is also connected to the chamber drain tank. In the event of a liquid spill within the chamber 100, liquid will drain from the port in the chamber floor to the chamber drain tank. A valve is provided to control the draining of fluid from the chamber floor to the chamber drain tank. In one embodiment, the valve is configured to open when fluid is present within the drain line that connects the chamber floor to the chamber drain tank. The platen vacuum tank has its own drain tank. The platen drain tank also serves as a vacuum tank. A vacuum generator is connected to the platen drain tank and is the source of the backside wafer vacuum. Valves are provided to control the vacuum present at the backside of the wafer. Also, sensors are also provided to monitor the pressure present at the backside of the wafer. The platen drain tank and chamber drain tank share a common drain pump. However, each of the platen drain tank and chamber drain tank has its own isolation valve between the tank and the pump to enable emptying of each tank independently.

While this invention has been described in terms of several embodiments, it will be appreciated that those skilled in the art upon reading the preceding specifications and studying the drawings will realize various alterations, additions, permutations and equivalents thereof. Therefore, it is intended that the present invention includes all such alterations, additions, permutations, and equivalents as fall within the true spirit and scope of the invention.

What is claimed is:

1. A system for semiconductor wafer electroless plating, comprising:

a chamber including a first wafer processing zone defined within an upper region of an internal volume of the chamber, the first wafer processing zone including upper and lower proximity heads defined to perform a drying a process on a wafer, the chamber including a second wafer processing zone within a lower region of the internal volume of the chamber, the second wafer processing zone including a fluid bowl defined to perform an electroless plating process on the wafer;

a platen defined to support the wafer within the chamber and provide transport of the wafer in a vertical direction between the first and second wafer processing zones;

a seal disposed around an interior surface of the fluid bowl so as to form a liquid tight barrier when the platen is lowered to engage the seal, wherein a space above the seal is open to a volume overlying the platen when the platen is lowered to engage the seal;

a number of fluid dispense nozzles positioned around the interior surface of the fluid bowl above the seal;

a first supply line connected to supply an electroless plating solution to the number of fluid dispense nozzles;

a mixing manifold including a fluid output connected to the first supply line, the mixing manifold including a number of fluid inputs for respectively receiving a number of chemicals, the mixing manifold defined to mix the number of chemicals to form the electroless plating solution; and a chemical fluid handling system defined to supply the number of chemicals to the number of fluid inputs of the mixing manifold in a controlled manner.

2. A system for semiconductor wafer electroless plating as recited in claim 1, wherein the mixing manifold is disposed to minimize a length of the first supply line extending from the mixing manifold to the number of fluid dispense nozzles.

3. A system, comprising:

a chamber including a first wafer processing zone defined within an upper region of an internal volume of the chamber, the first wafer processing zone including upper and lower proximity heads defined to perform a drying a process on a wafer, the chamber including a second wafer processing zone within a lower region of the internal volume of the chamber, the second wafer processing zone including a fluid bowl defined to perform an electroless plating process on the wafer;

a platen defined to support the wafer within the chamber and provide transport of the wafer in a vertical direction between the first and second wafer processing zones;

a seal disposed around an interior surface of the fluid bowl so as to form a liquid tight barrier when the platen is lowered to engage the seal, wherein a space above the seal is open to a volume overlying the platen when the platen is lowered to engage the seal;

a number of fluid dispense nozzles positioned around the interior surface of the fluid bowl above the seal;

a number of fluid recirculation loops, each fluid recirculation loop defined to pre-condition a chemical component of an electroless plating solution and control a supply of the chemical component to be used to form the electroless plating solution; and a mixing manifold defined to receive the chemical component from each fluid recirculation loop and mix the received chemical components to form the electroless plating solution, the mixing manifold further defined to supply the electroless plating solution to the number of fluid dispense nozzles;

a surface tension reducing fluid supply connected to each of the upper and lower proximity heads, wherein the upper proximity head is positioned directly above the lower proximity head within the first wafer processing zone;

a cleaning fluid supply connected to each of the upper and lower proximity heads; and a vacuum supply connected to each of the upper and lower proximity heads.

4. A fluid handling system for a semiconductor wafer electroless plating process as recited in claim 3, wherein each fluid recirculation loop includes a multiposition valve having a first setting defined to direct the chemical component within the fluid recirculation loop to flow in a recirculating manner through the fluid recirculation loop, the multiposition valve having a second setting defined to direct the chemical component within the fluid recirculation loop to flow to an input of the mixing manifold.

5. A fluid handling system for a semiconductor wafer electroless plating process as recited in claim 4, wherein each fluid recirculation loop includes a surge tank downstream from the multiposition valve, each fluid recirculation loop further including a second valve disposed between the multiposition valve and the surge tank, wherein the second valve is defined to enable matching of a first pressure drop from the multiposition valve to the surge tank with a second pressure drop from the multiposition valve to a location where the electroless plating solution is to be disposed over the wafer.

6. A fluid handling system for a semiconductor wafer electroless plating process as recited in claim 3, wherein each fluid recirculation loop includes a heater for heating the chemical component as the chemical component is circulated through the fluid recirculation loop.

7. A fluid handling system for a semiconductor wafer electroless plating process as recited in claim 3, wherein each fluid recirculation loop includes a degasser for removing gas from the chemical component as the chemical component is circulated through the fluid recirculation loop.

8. A fluid handling system for a semiconductor wafer electroless plating process as recited in claim 3, wherein each fluid recirculation loop includes a filter for removing particulate material from the chemical component as the chemical component is circulated through the fluid recirculation loop.

9. A fluid handling system for a semiconductor wafer electroless plating process as recited in claim 3, wherein the fluid handling system includes four fluid recirculation loops for respectively pre-conditioning and controlling the supply of four chemical components of the electroless plating solution, the fluid handling system further including a syringe pump defined to inject a fifth chemical component into the electroless plating solution downstream from the mixing manifold and at a location substantially near to where the electroless plating solution is to be disposed over the wafer.

10. A fluid handling system for a semiconductor wafer electroless plating process as recited in claim 3, wherein each fluid recirculation loop includes a pump and a flowmeter.

11. A fluid handling system for a semiconductor wafer electroless plating process as recited in claim 10, wherein the pump is defined to control a flow of the chemical component within its fluid recirculation loop to comply with a user defined flow rate.

12. A fluid handling system for a semiconductor wafer electroless plating process as recited in claim 11, wherein the pump is defined to read a current output from the flowmeter and adjust its pump speed to maintain a substantially constant flow rate.

13. A fluid handling system for a semiconductor wafer electroless plating process as recited in claim 10, wherein each fluid recirculation loop includes a filter, and wherein a speed of the pump is indicative of a state of the filter.

14. A system for semiconductor wafer electroless plating as recited in claim 1, wherein the chemical fluid handling system includes a separate recirculation loop for each of the number of chemicals to be supplied to the mixing manifold, wherein each recirculation loop is defined to pre-condition a particular one of the number of chemicals and control a supply of the particular one of the number of chemicals to the number of fluid dispense nozzles by way of the mixing manifold.

15. A system for semiconductor wafer electroless plating as recited in claim 14, further comprising:

a second supply line connected to supply a surface tension reducing fluid to the upper proximity head;

a third supply line connected to supply a cleaning fluid to the upper proximity head;

a first vacuum supply line connected to supply vacuum suction to the upper proximity head;

a fourth supply line connected to supply the surface tension reducing fluid to the lower proximity head;

a fifth supply line connected to supply the cleaning fluid to the lower proximity head; and a second vacuum supply line connected to supply vacuum suction to the lower proximity head.

16. A system for semiconductor wafer electroless plating as recited in claim 15, further comprising:

a rinse fluid handling system connected to each of the second, third, fourth, and fifth supply lines and the first and second vacuum supply lines, the rinse fluid handling system defined to supply the surface tension reducing fluid, the cleaning fluid, and the vacuum suction to the upper proximity head so as to form a first fluid meniscus between the upper proximity head and the wafer when the wafer is present within the first wafer processing zone, the rinse fluid handling system also defined to supply the surface tension reducing fluid, the cleaning fluid, and the vacuum suction to the lower proximity head so as to form a second fluid meniscus between the lower proximity head and the wafer when the wafer is present within the first wafer processing zone.

17. A system for semiconductor wafer electroless plating as recited in claim 14, further comprising:

a chemical supply fluid handling system including a number of chemical supply tanks connected to respectively supply the number of chemicals to the recirculation loops.

18. A system for semiconductor wafer electroless plating as recited in claim 16, wherein the upper proximity head is defined to apply vacuum suction from the first vacuum supply line to a position within the first fluid meniscus between a location where the surface tension reducing fluid is applied to the first fluid meniscus and a location where the cleaning fluid is applied to the first fluid meniscus, and wherein the lower proximity head is defined to apply vacuum suction from the second vacuum supply line to a position within the second fluid meniscus between a location where the surface tension reducing fluid is applied to the second fluid meniscus and a location where the cleaning fluid is applied to the second fluid meniscus.

19. A system for semiconductor wafer electroless plating as recited in claim 18, wherein the surface tension reducing fluid includes isopropyl alcohol vapor entrained in a nitrogen carrier gas.

20. A system for semiconductor wafer electroless plating as recited in claim 14, wherein each recirculation loop includes a surge tank, a pump, a degasser, a heater, a flowmeter, and a filter.

21. A system for semiconductor wafer electroless plating as recited in claim 20, wherein the pump is defined to control a flow of the particular one of the number of chemicals within its recirculation loop to comply with a user defined flow rate.

22. A system for semiconductor wafer electroless plating as recited in claim 21, wherein the pump is defined to read a current output from the flowmeter and adjust its pump speed to maintain a substantially constant flow rate.

23. A system for semiconductor wafer electroless plating as recited in claim 21, wherein a pump speed is indicative of a state of the filter.

* * * * *